US006760006B2

(12) United States Patent
Arita et al.

(10) Patent No.: US 6,760,006 B2
(45) Date of Patent: Jul. 6, 2004

(54) INPUT DEVICE FOR USE IN A COMPUTER SYSTEM

(75) Inventors: Takashi Arita, Tokyo (JP); Katsuya Funakoshi, Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 10/293,339

(22) Filed: Nov. 14, 2002

(65) Prior Publication Data

US 2003/0071785 A1 Apr. 17, 2003

Related U.S. Application Data

(62) Division of application No. 09/285,884, filed on Apr. 7, 1999.

(30) Foreign Application Priority Data

Apr. 10, 1998 (JP) ..... 10-99517
Mar. 1, 1999 (JP) ..... 11-52468

(51) Int. Cl.[7] ..... G09G 5/00
(52) U.S. Cl. ..... 345/156; 345/161
(58) Field of Search ..... 345/156, 157, 345/161; 74/471 XY

(56) References Cited

U.S. PATENT DOCUMENTS 4,305,007 A * 12/1981 Hughes ..... 307/116
4,825,157 A * 4/1989 Mikan ..... 324/207.2
5,068,498 A 11/1991 Engel
5,724,068 A * 3/1998 Sanchez et al. ..... 345/161
5,751,274 A * 5/1998 Davis ..... 345/157
5,831,596 A 11/1998 Marshall et al.
5,995,104 A * 11/1999 Kataoka et al. ..... 345/848
6,171,191 B1 * 1/2001 Ogata et al. ..... 463/38
6,259,433 B1 7/2001 Meyers
6,266,046 B1 7/2001 Arita
6,307,486 B1 * 10/2001 Takeda et al. ..... 341/20
6,501,458 B2 * 12/2002 Baker et al. ..... 345/161

FOREIGN PATENT DOCUMENTS

JP 7-117876 12/1995
JP 9-134251 5/1997

* cited by examiner

*Primary Examiner*—Amare Mengistu
(74) *Attorney, Agent, or Firm*—Staas & Halsey LLP

(57) ABSTRACT

An input device for inputting information corresponding to a direction of inclination and an angle of inclination of a movable part into devices such as a computer. The input device includes a substantially spherical part provided at a lower end of said movable part; bearing means which rotatably supports said substantially spherical part of said movable part; a recovery means which rotates said substantially spherical part within said bearing means so as to recover the upright position of the movable part; and inclination detecting means which detects a direction of inclination and an angle of inclination of said movable part.

10 Claims, 32 Drawing Sheets

20A

1Aa, 123A, 7A } 15A 4A, 3Aa } 16A 6A, 9AX1~9AY2 } 17A

| VOLTAGE | OUTPUT VALUE |
|---|---|
| a (V) | 1 (COUNT) |
| ⋮ | ⋮ |
| b (V) | 1 2 8 (COUNTS) |
| ⋮ | ⋮ |
| c (V) | 2 5 6 (COUNTS) |

UPRIGHT POSITION

TILTED POSITION

INPUT DEVICE FOR USE IN A COMPUTER SYSTEM

CROSS-REFERENCE TO RELATED APPLICATIONS

This application is a divisional application of application Ser. No. 09/285,884, filed Apr. 7, 1999, now allowed.

BACKGROUND OF THE INVENTION

1. Field of the Invention

The present invention generally relates to an input device used in a computer system, and particularly relates to a pointing device for moving a cursor to a desired position in a display and to an acceleration-measuring apparatus.

2. Description of the Related Art

Recently, many computer systems are provided with pointing devices as well as keyboards, so as to provide a data input means of an improved operability.

Pointing devices such as mouses and digitizers have been commonly used for desktop type computers. However, laptop type or notebook type portable computers require pointing devices which can be used at places where no flat working surface is available.

Thus, various pointing devices, such as a track-ball type pointing device, which are reduced in size and do not require a flat working surface have been developed.

FIG. 1 is a diagram showing an example of a pointing device 100 of the related art.

As shown in FIG. 1, the pointing device 100 of the related art is provided with a rod 101. The rod 101 and a supporting frame 102 are connected via a tightly wound coil spring 103.

A coordinate detecting part 104 is provided underneath the rod 101 and the supporting frame 102. The coordinate detecting part 104 includes, for example, a light-emitting element 105 provided at a lower end of the rod 101 and a light-receiving element 106 mounted on a printed-circuit board 107 at a position opposing the light-emitting element 105.

The light-receiving element 106 may be a CCD having a number of light-receiving parts arranged in a matrix form. When the rod 101 is pushed in a desired direction with a horizontal force, the coil spring 103 is bent and a shaft center of the operating rod 101 is tilted. Thus, a direction of irradiation of the light-emitting element 105 changes.

As a result, corresponding to a direction and an angle of inclination, a light beam from the light-emitting element 105 is incident on a specific light-receiving part on the light-receiving element 106. Then, electric signals are output from the light-receiving parts provided on the light-receiving element 106 at positions corresponding to coordinates of the direction and the angle of inclination of the rod 101.

The above-described pointing device 100 of the related art has comparatively large size and weight. Therefore, the pointing device of the related art is cumbersome and difficult to handle with ease. That is to say, there is a problem that the pointing device is not suitable for use by small children.

Therefore, there is a need for a pointing device which is usable for all ages. Further, there is a need for a pointing device with a reduced size and a good operability.

SUMMARY OF THE INVENTION

Accordingly, it is a general object of the present invention to provide an input device which can satisfy the needs described above.

It is another and more specific object of the present invention to provide an input device having an operating part which returns to its initial position when released.

In order to achieve the above objects, an input device includes a substantially spherical part provided at a lower end of said movable part; bearing means which rotatably supports said substantially spherical part of said movable part; a recovery means which rotates said substantially spherical part within said bearing means so as to recover the upright position of the movable part; and inclination detecting means which detects a direction of inclination and an angle of inclination of said movable part.

The input device described above may be embodied as a pointing device or as an acceleration measuring device. With the structure describe above, it is possible to obtain an input device with a reduced size.

The recovery means may include a cover having a cylindrical part; a plurality of protrusions protruding outward from said substantially spherical part; a slider slidably provided in said cylindrical part of said cover, a lower end of said slider being supported by said protrusions; and a spring which downwardly spring-biases said slider.

With the recovery means described above, the input device can be operated with less operational force. Further, it is ensured that the slider and the movable part will recover its original position.

Other objects and further features of the present invention will be apparent from the following detailed description when read in conjunction with the accompanying drawings.

DETAILED DESCRIPTION OF THE PREFERRED EMBODIMENTS

In the following, principles and embodiments of the present invention will be described with reference to the accompanying drawings.

Figure 1:
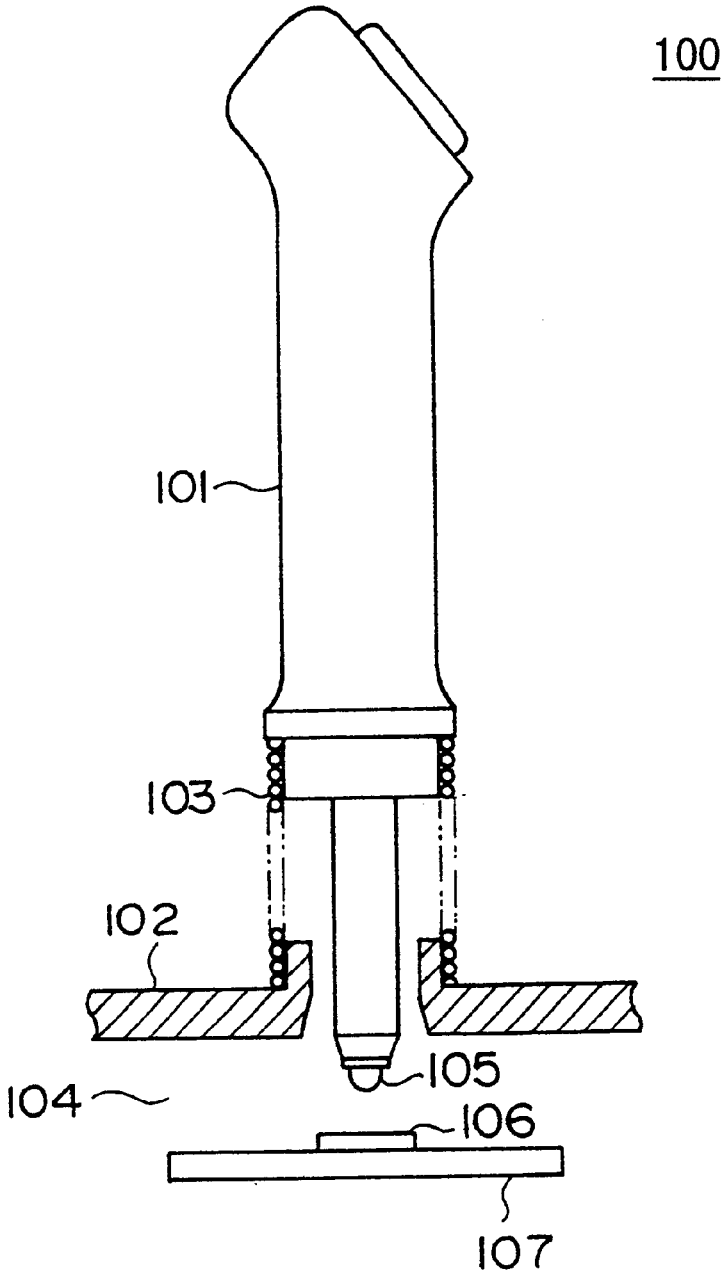
FIG. 1 PRIOR ART
FIG. 1 is a diagram showing a pointing device of the related art.
Figure 2:
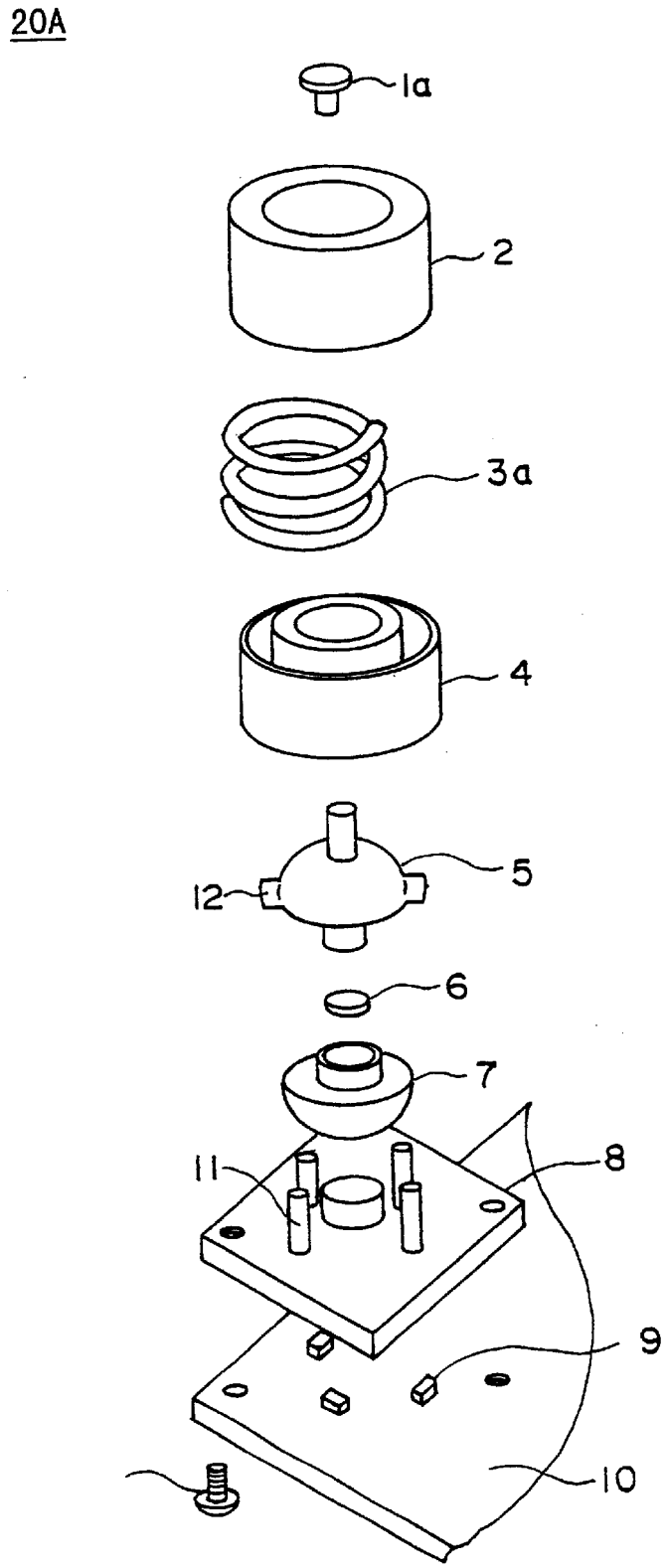
FIG. 2 is an exploded view showing an input device of a first embodiment of the present invention, embodied as a pointing device.

FIG. 2 is an exploded view showing an input device of a first embodiment of the present invention, embodied as a pointing device 20A.

The pointing device 20A of the present invention includes a cover 2 and a housing 8 accommodating an operating part 15, a pressurizing part 16 and a coordinate detecting part 17. The operating part 15 has a disk-type key top 1*a*, a stick 5 and a holder 7. The stick 5 is provided with a plurality of protrusions 12 arranged in a plane perpendicular to an axis of the stick 5 and passing through the center of inclination of the stick 5. The pressurizing part 16 includes a slider 4 and a compression coil spring 3*a*. The coordinate detecting part 17 includes a (permanent) magnet 6 and a magneto-electric converting element 9. All of the above-described components are assembled on a printed-circuit board (PCB) 10 so as to complete a pointing device as shown in FIG. 3.

Figure 9C:
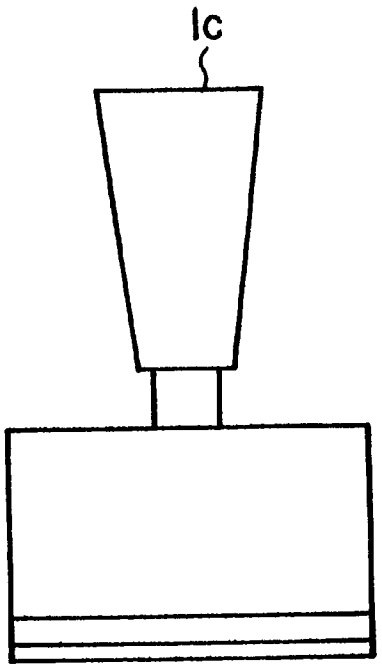
FIGS. 9A to 9C are side views showing various types of key tops, a disk type, a stick type and a dome type, respectively, used in the pointing device of the present invention.
Figure 9B:
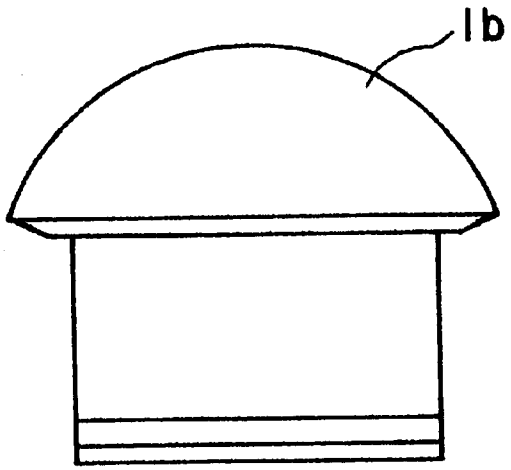
Figure 9A:
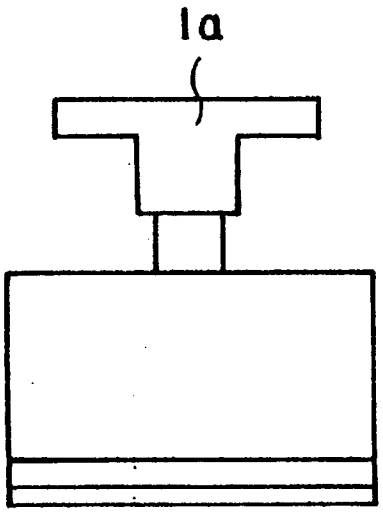

The pointing device 20A is provided with the disk-type key top 1*a* (see FIG. 9A). However, the shape of the key top is not limited to the disk type, but can be a key top of any type, such as a dome-type key top 1*b* (see FIG. 9B) and a stick-type key top 1*c* (see FIG. 9C).

By using the pointing device 20A, it is possible to move a cursor to a desired position in a display. Further, as shown in FIG. 2, the pointing device 20A of the present invention is provided with a plurality of bosses 11 on the housing 8 arranged in a concentric circle having a common center with the operating part 15 and provided between a plurality of protrusions 12. Thus, it is possible to operate the pointing device in a more stable manner.

Figure 3:
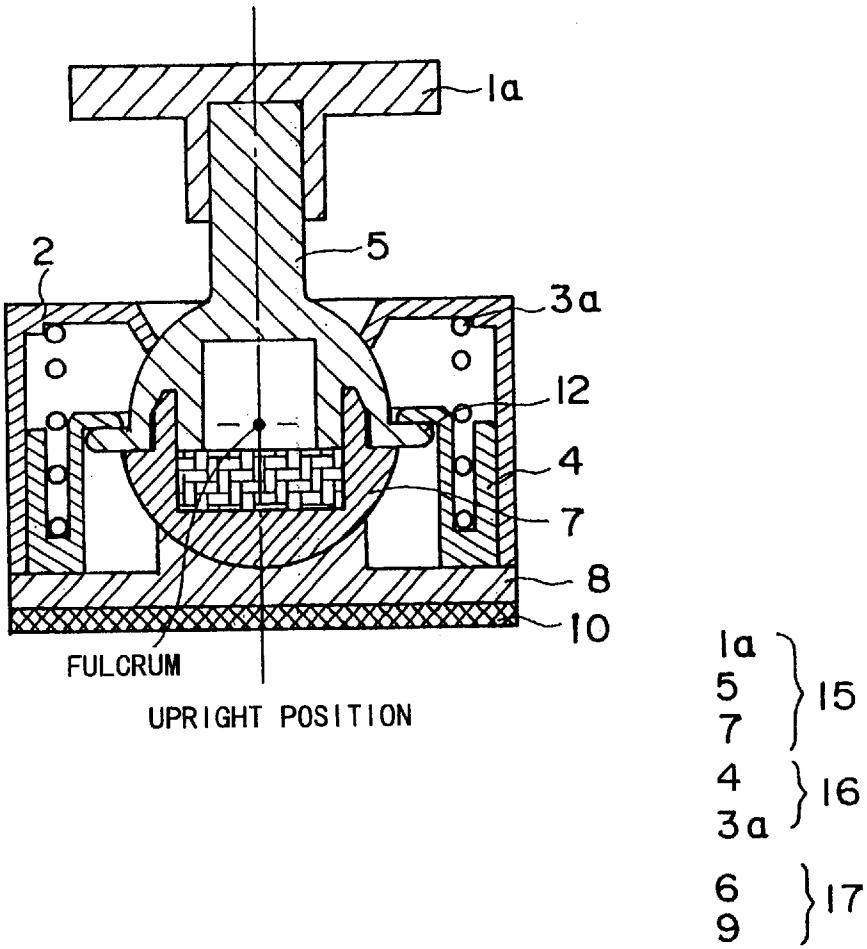
FIG. 3 is a cross-sectional diagram showing the pointing device of the first embodiment of the present invention in an upright position.
Figure 4:
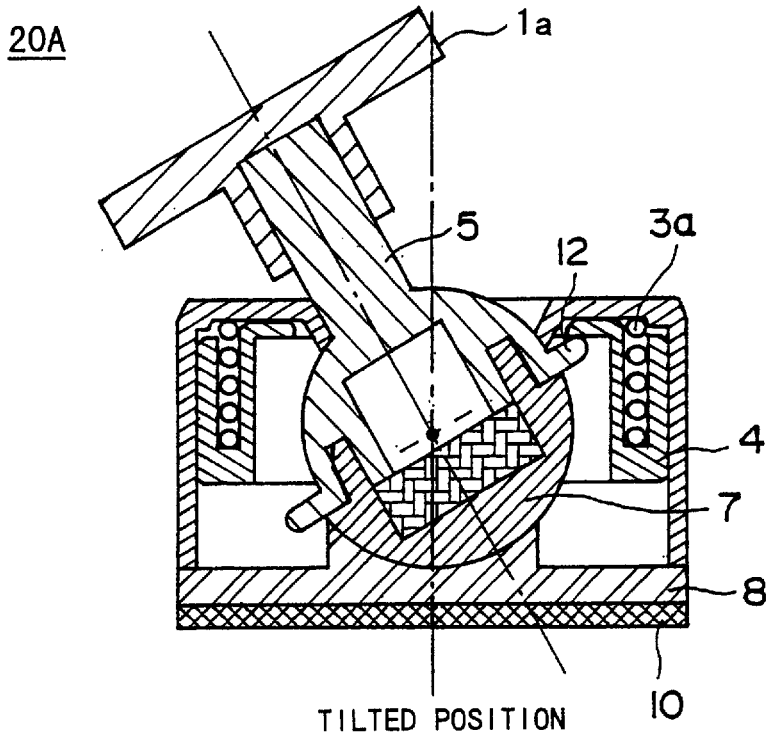
FIG. 4 is a cross-sectional diagram showing the pointing device of the first embodiment of the present invention in a tilted position.

As shown in FIG. 3, the holder 7 has a substantially hemispherical contact surface corresponding to a partly spherical bearing recess of the housing 8. Referring to FIG. 4, when the key top 1*a* and the stick 5, serving as a shaft, are tilted, the holder 7 slides on the recess of the housing 8 with the center of the hemispherical contact surface as a fulcrum (center of inclination). In this inclined state, the slider 4 is pushed up by at least one of the protrusions 12 and thus compresses the compression coil spring 3*a*.

Figure 5:
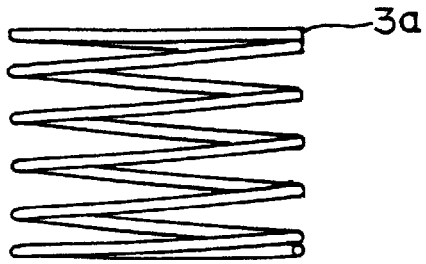
FIG. 5 is a diagram showing a first type of a spring used in the present invention which spring has a configuration of a compression coil spring.

The pointing device 20A of the present invention includes the pressurizing part 16 which exerts a recovery force for the operating part 15 to return to an upright position. Therefore, when the operating part 15 is released, it will automatically return to the initial upright position as shown in FIG. 3. A single compression coil spring 3*a* is sufficient to bring the operating part 15 back into its upright position. FIG. 5 is a diagram of the compression coil spring 3*a* used in the present embodiment.

Figure 6A:
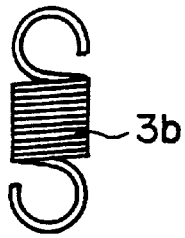
FIG. 6A is a diagram showing a second type of a spring used in the present invention which spring has a configuration of a tension coil spring.
Figure 6B:
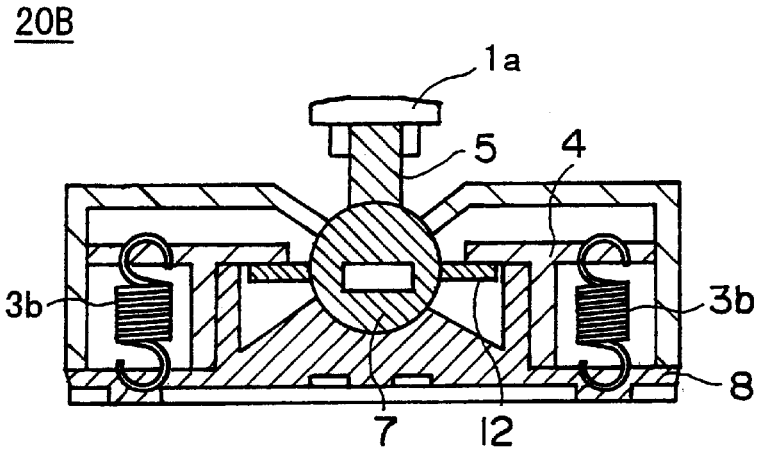
FIG. 6B is a cross-sectional diagram showing a pointing device of the first embodiment of the present invention using the tension coil spring shown in FIG. 6A.
Figure 6C:
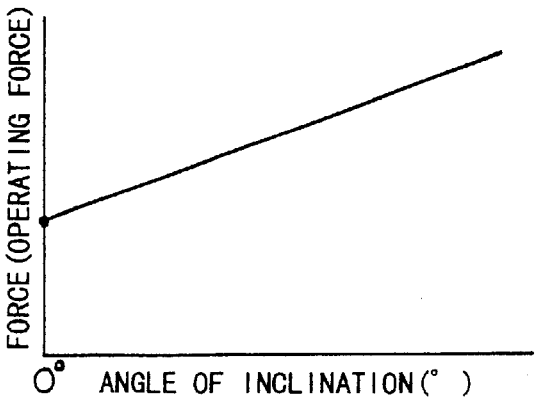
FIG. 6C is a graph of a force of a spring (operating force) against an angle of inclination, showing a characteristic of the tension coil spring shown in FIG. 6A.

Also, a tension coil spring 3*b* shown in FIG. 6A can be used in the pointing device of the present invention. FIG. 6B is a diagram showing a pointing device 20B using the tension coil springs 3*b*. As has been described with the compression coil spring 3*a*, when the key top 1*a* and the stick 5, serving as a shaft, are tilted, the holder 7 slides on the recess of the housing 8 with the center of the hemispherical contact surface as a fulcrum (center of inclination). In this inclined state, the slider 4 is pushed up by at least one of the protrusions 12 and pulls one of the tension coil springs 3*b*. As shown in FIG. 6C, an angle of inclination of the operating part 15 is proportional to a force of the spring (operating force). Therefore, the operating force increases as the angle of inclination increases.

The pointing device 20B of the present invention includes the pressurizing part 16 which exerts a recovery force for the operating part 15 to return to an upright position. Therefore, when the operating part 15 is released, it will automatically return to the initial upright position shown in FIG. 6B. A plurality of tension coil springs 3*b* bring the operating part 15 back into its upright position.

Figure 7B:
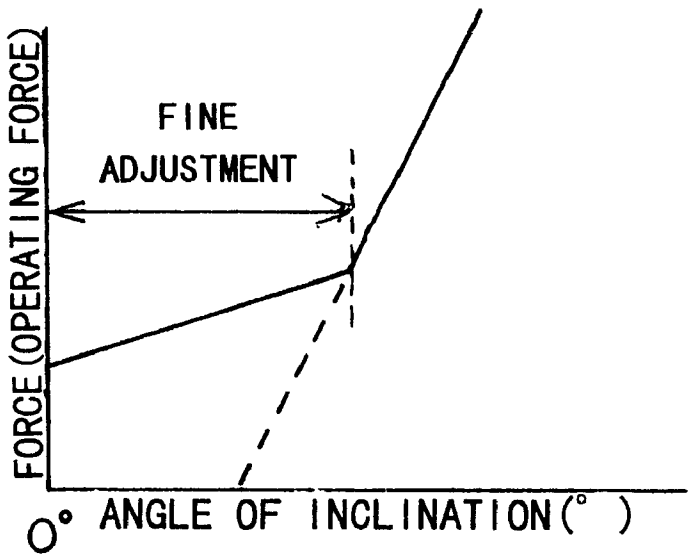
FIG. 7B is a graph of a force of a spring (operating force) against an angle of inclination, showing a characteristic of the unevenly pitched coil spring shown in FIG. 7A.
Figure 7A:
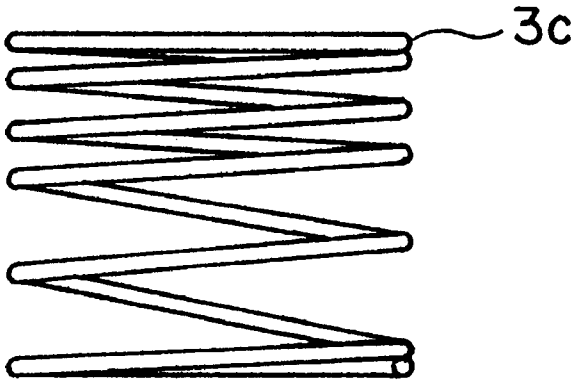
FIG. 7A is a diagram showing a third type of a spring used in the present invention which spring has a configuration of an unevenly pitched coil spring.

FIG. 7A is a diagram showing an unevenly pitched coil spring 3*c* which can be used in the pointing device of the present invention.

As has been described with the compression coil spring 3*a*, when the key top 1*a* and the stick 5, serving as a shaft, are tilted, the holder 7 slides on the recess of the housing 8 with the center of the hemispherical contact surface as a fulcrum (center of inclination). In this inclined state, the slider 4 is pushed up by at least one of the protrusions 12 and compresses the unevenly pitched coil spring 3*c*. In this case, as indicated in the graph shown in FIG. 7B, a fine operation (fine adjustment) and a coarse operation (coarse adjustment) are possible because of the difference in the strength of force exerted by the unevenly pitched coil spring 3*c*.

The pointing device 20A of the present invention includes the pressurizing part 16 which exerts a recovery force for the operating part 15 to return to an upright position. Therefore, when the operating part 15 is released, it will automatically return to the initial upright position as shown in FIG. 3. A single unevenly pitched coil spring 3*c* is sufficient to bring the operating part 15 back into its upright position.

In the pointing device of the present invention using any one of the springs shown in FIGS. 5, 6A and 7A, the coordinate detecting part 17 detects a direction and an angle of inclination of the operating part 15 by converting the change in magnetic field of the magnet 6 into an electric signal and further processing this electric signal. As a result, it is possible to move a cursor in a desired direction (up, down, right, left and diagonally) in the display.

In the following, an operation of the pointing device of the present invention for moving the cursor will be described.

For example, consider a case where four protrusions 12 are provided on the stick 5, constituting the operating part 15, at equal intervals. Then, when the operating part 15 is tilted in a direction of one of the protrusions 12, the slider 4 will be moved by a greater amount, whereas, when the operating part 15 is tilted in the direction between adjacent ones of the protrusions 12, the slider 4 will be moved by a smaller amount. In other words, a greater operating force is required for tilting the operating part 15 in the direction of one of the protrusions 12, and a smaller operating force is sufficient for tilting the operating part 15 in the direction between adjacent ones of the protrusions 12.

Figure 8:
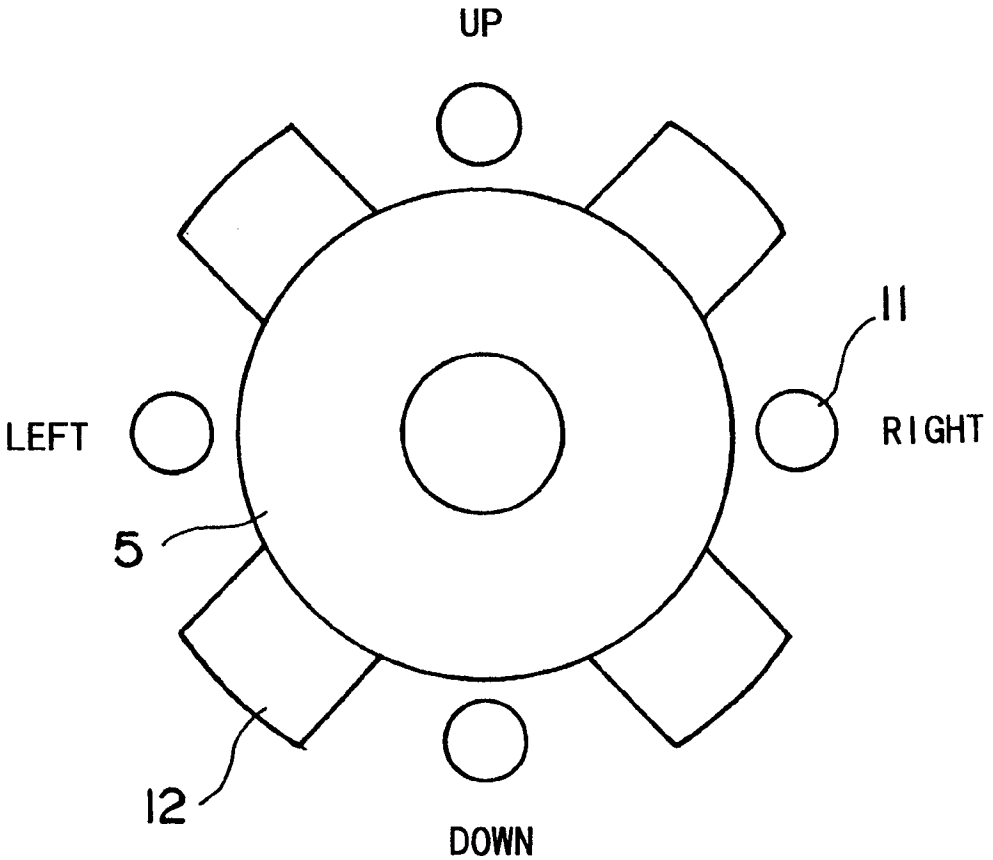
FIG. 8 is a schematic diagram showing the positioning of the protrusions with respect to the direction of operation, in a case where four protrusions are provided.

FIG. 8 is a schematic diagram showing the positioning of the protrusions 12 with respect to the direction of operation, in a case where four protrusions are provided. In FIG. 8, four directions between adjacent protrusions 12, each of which directions requiring a smaller operating force, are arranged as up, down, right and left directions of the movement of the cursor, respectively. Therefore, since the direction of movement of the cursor can be sensed by hand according to the difference between the greater force and the smaller force, it is possible to realize an improved operability. Also, the number of protrusions 12 provided on the pointing device of the present invention is not limited to four or eight, but can be any number convenient for the operator.

Figure 10:
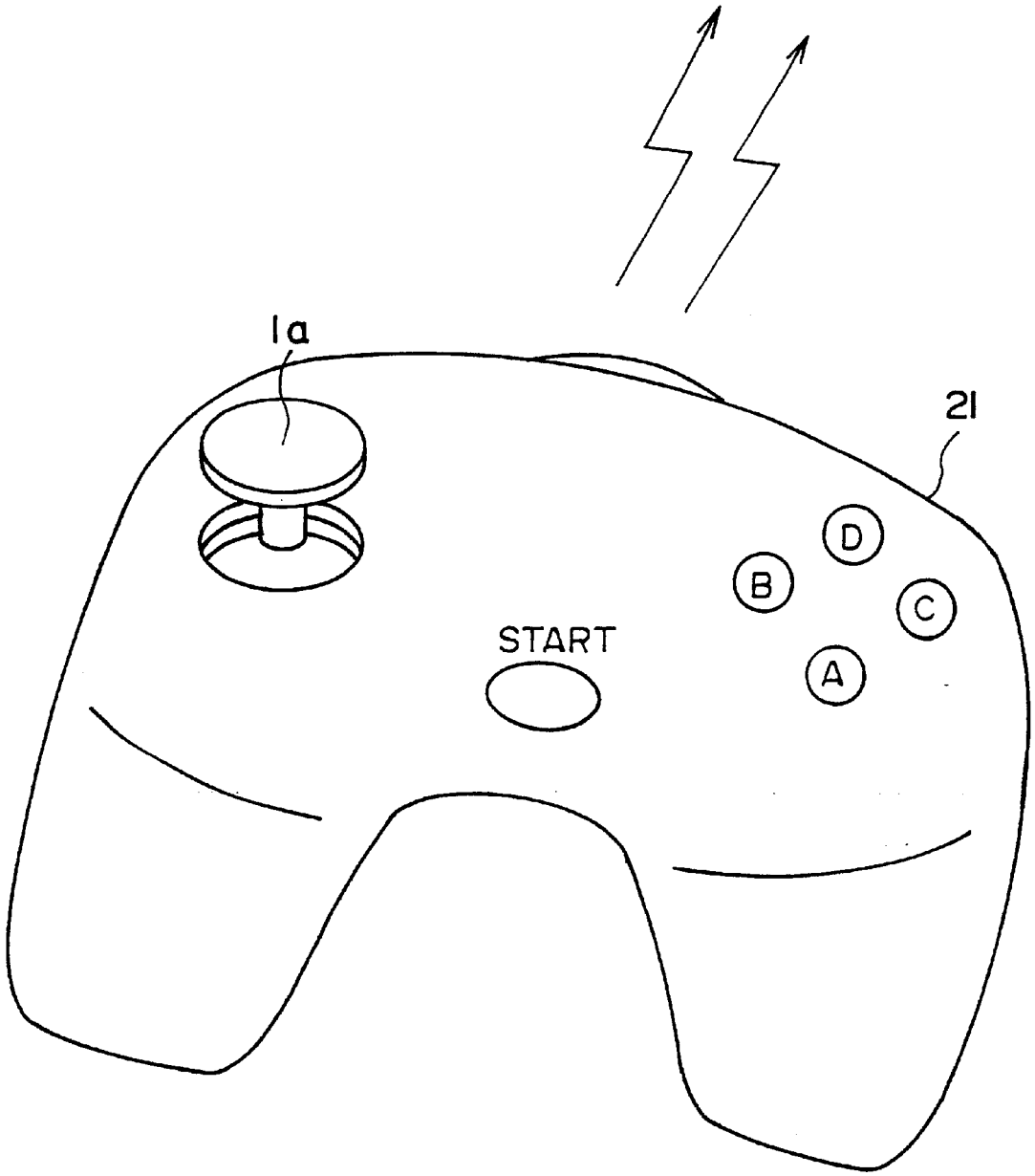
FIG. 10 is a diagram showing an example of an application of the pointing device of the present invention.

FIG. 10 is a diagram showing an example of an application of the pointing device of the present invention. The pointing device of the present invention is incorporated in a cordless remote control unit 21 for moving a cursor in a desired direction (up, down, right, left and diagonally) in the display. Also, an application of the pointing device of the present invention is not limited to a cordless remote control unit, but can also be applied to a remote control unit of a wired type or a built-in type mounted inside a computer.

Figure 11:
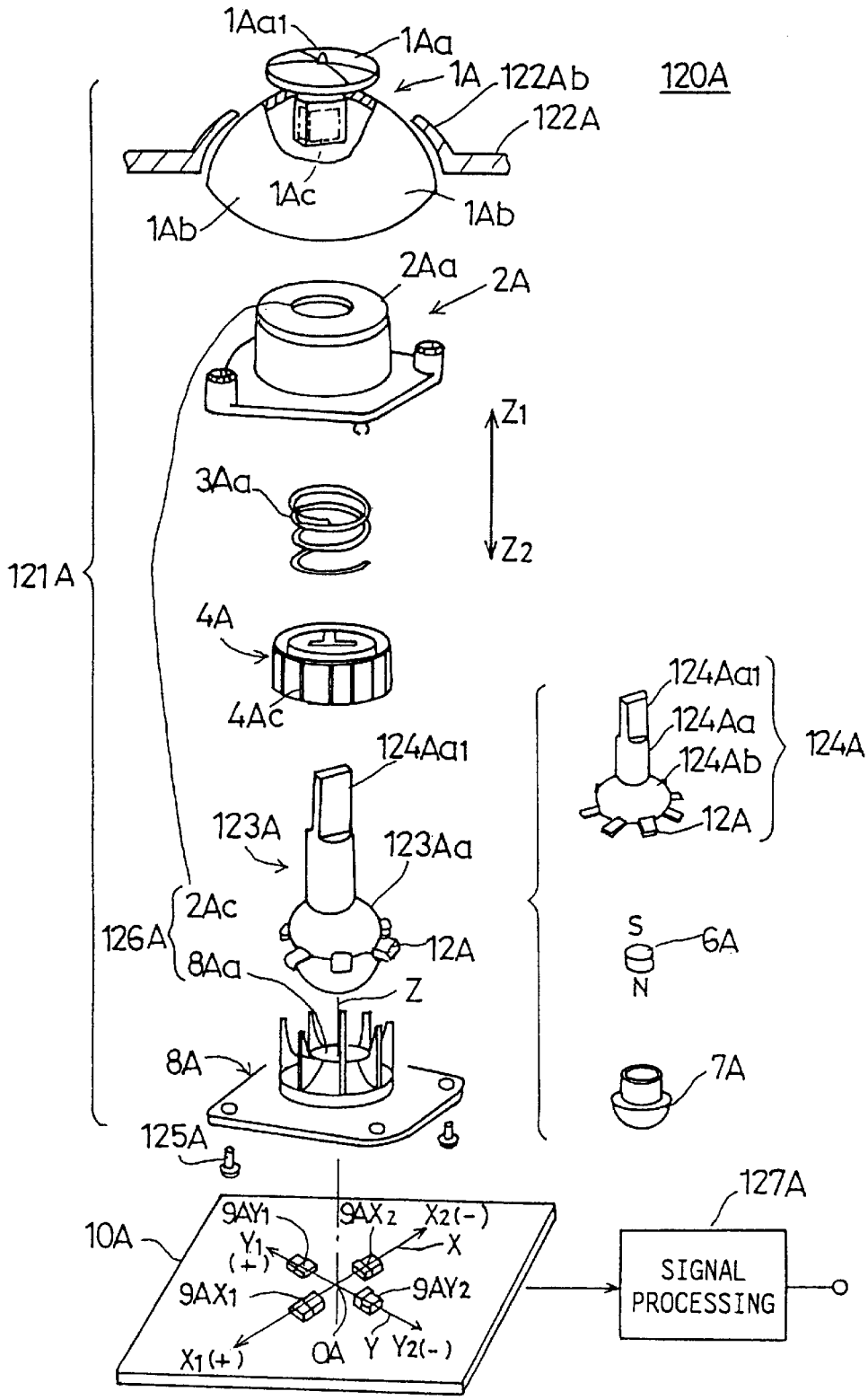
FIG. 11 is an exploded view showing an input device of a second embodiment of the present invention, embodied as a pointing device.
Figure 12A:
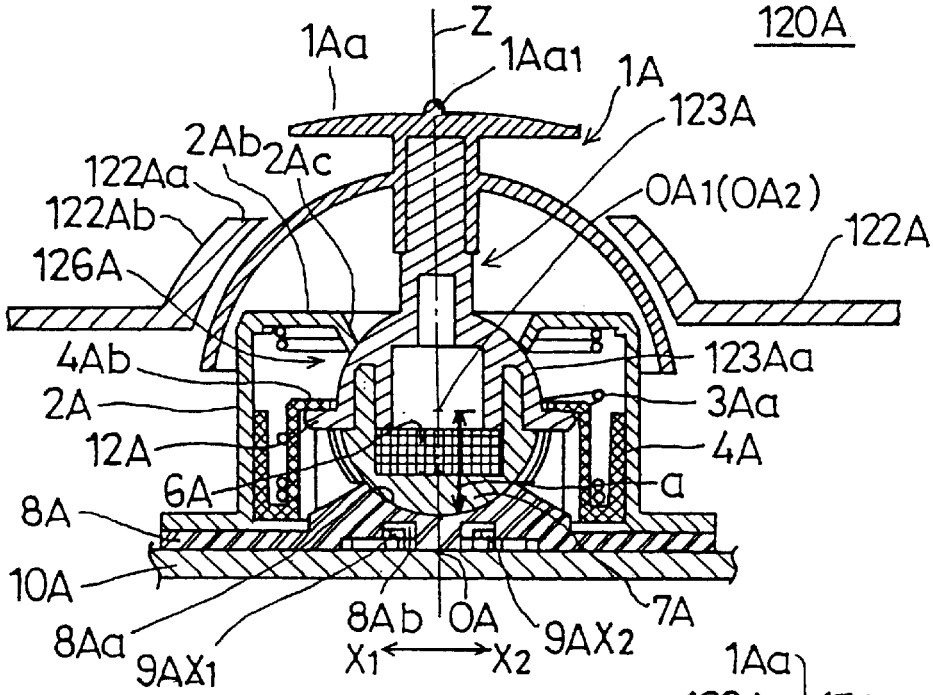
FIGS. 12A and 12B are cross-sectional diagrams showing the pointing device of the second embodiment of the present invention in an upright position and in a tilted position, respectively.
Figure 12B:
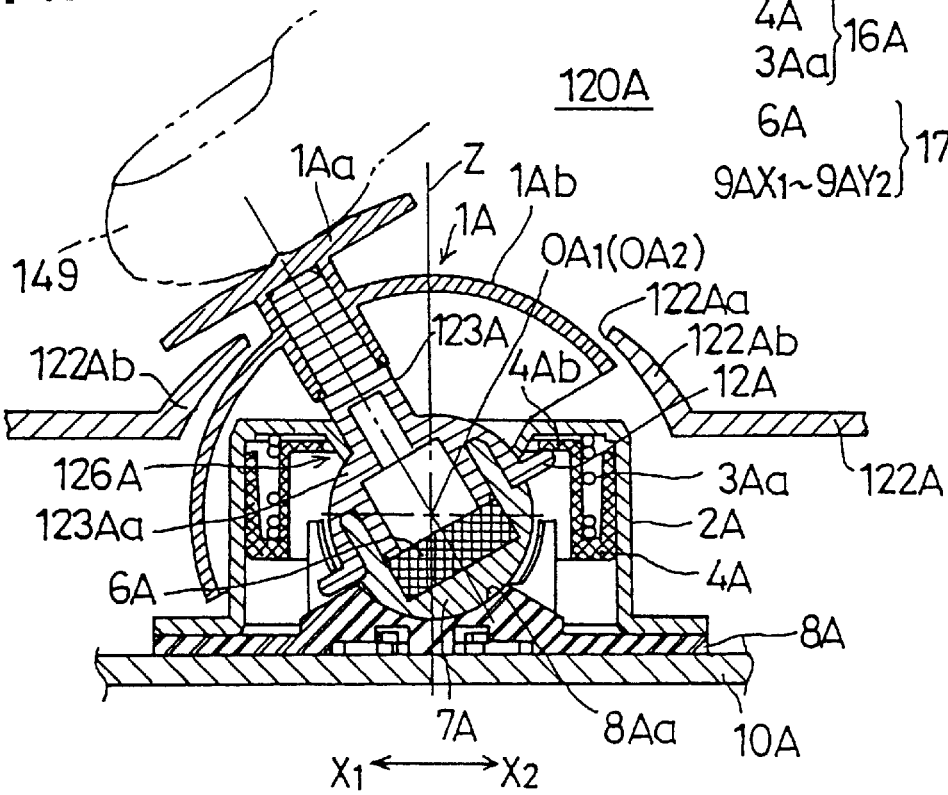

FIGS. 11, 12A and 12B are diagrams showing an input device of a second embodiment of the present invention, embodied as a pointing device 120A. In any of the following figures, components similar to the components shown in FIGS. 2 and 3 are indicated by the same reference numerals accompanied by a suffix. In the figures, an X-axis and a Y-axis are lying in a plane of an upper surface of a printed-circuit board 10A and are mutually perpendicular. A Z-axis passes through a cross-point OA of the X- and Y-axes in a direction perpendicular to the plane of the upper surface of the printed-circuit board 10A. An upward direction is shown by a reference Z1 and a downward direction is shown by a reference Z2.

As shown in FIGS. 11 and 12A, the pointing device 120A includes a pointing device main-body assembly 121A, the printed-circuit board 10A and a signal processing circuit 127A. Four magnetoelectric converting elements 9AX1, 9AX2, 9AY1 and 9AY2 are mounted on the printed-circuit board 10A. The signal processing circuit 127A processes the signals from the magnetoeletric converting elements 9AX1, 9AX2, 9AY1 and 9AY2 and outputs predetermined signals.

As will be described later, the pointing device main-body assembly 121A is assembled independently from the printed-circuit board 10A. The pointing device main-body assembly 121A is mounted on the printed-circuit board 10A so as to cover the magnetoeletric converting elements 9AX1, 9AX2, 9AY1 and 9AY2 and in such a manner that a disk-type key top 1A is protruded upward from a box-like outer case 122A.

First of all, the pointing device main-body assembly 121A will be described. The pointing device main-body assembly 121A includes an operating part 15A and a pressurizing part 16A, which are accommodated in a housing 8A and covered by a cover 2A.

The pointing device main-body assembly 121A is assembled in the following manner. First, a stick assembly 123A is placed on the housing 8A. Then, a slider 4A is fitted on the stick assembly 123A. Further, a single compression coil spring 3Aa is mounted on the slider 4A. The compression coil spring 3Aa is covered by the cover 2A, which is screwed onto the housing 8A by means of screws 125A. Then, the key top 1A is fixed on a stick part 124Aa protruding upward from the cover 2A.

The operating part 15A includes the stick assembly 123A and the key top 1A fixed at the top end of the stick assembly 123A.

As shown in FIG. 11, the stick assembly 123A includes a stick 124A, a disk-shaped magnet 6A magnetized in its thickness direction, and a hemispherical holder 7A. The magnet 6A is accommodated in the holder 7A in a horizontal manner with its center lying on an axis (Z-axis) of the stick assembly 123A. The stick 124A includes the stick part 124Aa and a hemispherical part 124Ab provided at a lower end of the stick part 124Aa. The hemispherical part 124Ab is provided with eight protrusions 12A provided radially at equal angular intervals in a plane perpendicular to the Z-axis.

As shown in FIGS. 12A and 12B, the holder 7A is fixed at the lower end of the stick 124A, so that a spherical part 123Aa is provided which is formed by the holder 7A and the hemispherical part 124Ab. The center of the spherical part 123Aa is indicated by a reference OA1. In other words, the spherical part 123Aa is provided at the lower end of the stick assembly 123A. The protrusions 12A are positioned in a plane lying through the center OA1 in a direction perpendicular to the Z-axis. Also, the holder 7A may take a form of a polyhedron which has a substantially hemispherical shape. Similarly, the spherical part 123Aa may take a form of a polyhedron which has a substantially hemispherical shape.

The key top 1A includes a key-top main body 1Aa and a hemispherical dome part 1Ab provided at a lower end of the key-top main body 1Aa. The key-top main body 1Aa is configured as a disk having a size corresponding to a fingertip of the user and its top surface is provided with a projected part 1Aa1 so as to prevent a slippage of the finger tip. The dome part 1Ab has a size sufficient for covering a cylindrical part 2Aa of the cover 2A. At the lower end of the key-top main body 1Aa, a fitting recess 1Ac having a rectangular opening is provided, which fitting recess 1Ac projects into the dome part 1Ab. The key top 1A is secured at the top end of the stick 124A with the fitting recess 1Ac being fitted with a columnar part 124Aa1 at an upper end of the stick part 124Aa protruding upward from the cylindrical part 2Aa of the cover 2A.

Figure 13A:
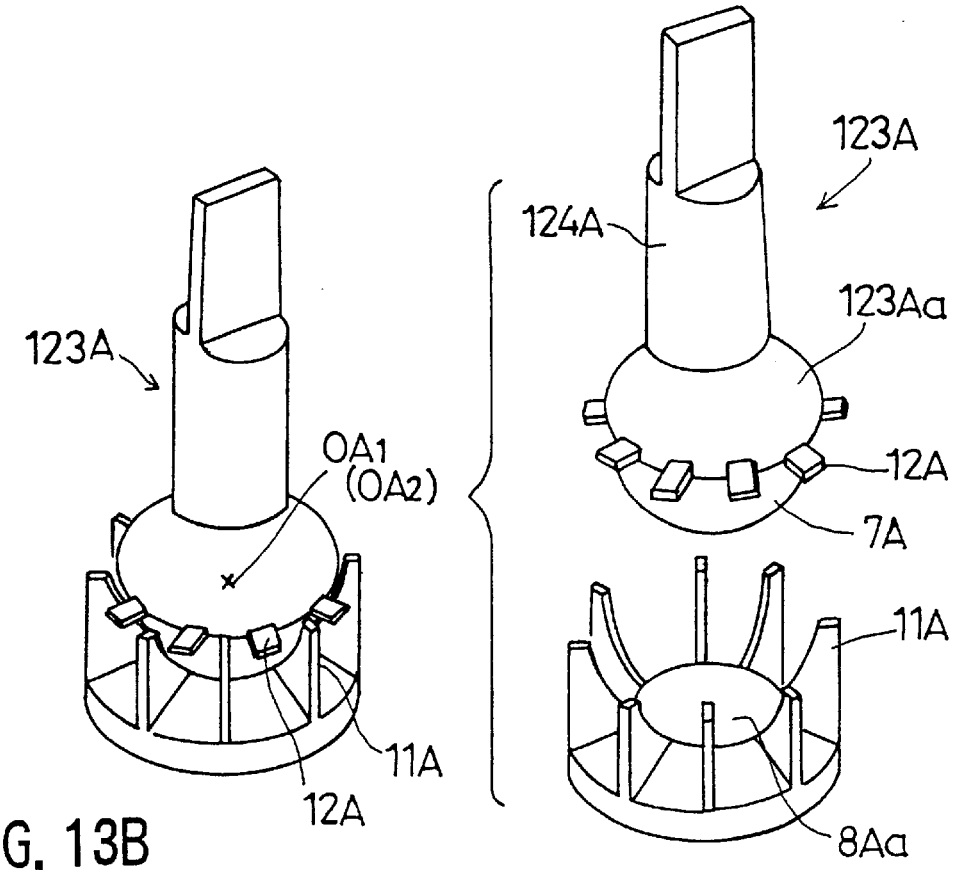
FIG. 13A is a perspective diagram showing a stick assembly together with a housing.

As shown in FIG. 13A, the housing 8A is provided with a receiving seat 8Aa of a concave shape and eight bosses 11A. The bosses 11A are plate-like and are provided at equal angular intervals along the periphery of the receiving seat 8Aa. The housing 8A is made of an elastomeric material. Thus, the bosses 11 are elastic and are capable of being easily flexed in a peripheral direction of the receiving seat 8Aa.

The stick assembly 123A is supported by the receiving seat 8Aa in such a manner that the holder 7A constituting a lower part of the spherical part 123Aa is placed on the receiving seat 8Aa with the surface of the holder 7A being greased. The cover 2A has a rim 2Ac, which is provided so as to oppose the hemispherical part 124Ab constituting an upper part of the spherical part 123Aa. The rim 2Ac and the hemispherical part 124Ab are either mutually in contact or separated with a small gap. The rim 2Ac is provided at a position closer to the center compared to the position of a flange 2Ab. With the spherical part 123Aa being supported in a rotatable manner by the receiving seat 8Aa and the rim 2Ac, the stick assembly 123A may be inclined but is not movable as a unit in the X, Y and Z-directions.

The receiving seat 8Aa and the rim 2Ac constitute a bearing part 126A of the spherical part 123Aa. The spherical part 123Aa is rotatable inside the bearing part 126A. As shown in FIG. 12A, the center OA1 of the spherical part 123Aa corresponds to the center OA2 of the receiving seat 8Aa. Also shown in FIG. 13B, each protrusion 12A is positioned between neighboring bosses 11A.

Figure 13B:
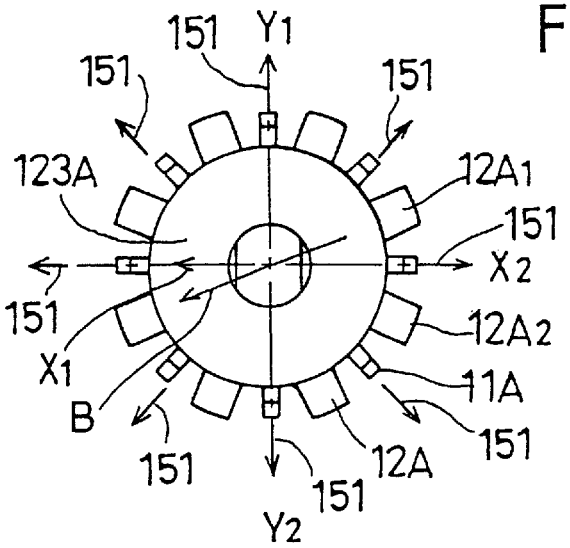
FIG. 13B is a top view showing the stick assembly together with the housing.
Figure 13C:
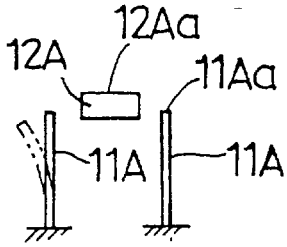
FIG. 13C is a partial side view of the stick assembly and the housing, particularly showing one of the protrusions and its neighboring bosses.

FIG. 13C is a partial side view of the stick assembly and the housing, particularly showing one of the protrusions and its neighboring bosses. As shown in the figure, an upper surface 12Aa of the protrusion 12A is at a level slightly above a tip surface 11Aa of the boss 11A.

When the stick assembly 123A is pulled in the Z1-direction, the rim 2Ac of the cover 2A will receive the surface of the hemispherical part 124Ab. Thus, the stick assembly 123A is prevented from being expelled out of the cover 2A.

In the following, the pressurizing part 16A including the slider 4A and the compression coil spring 3Aa will be described.

Figure 14:
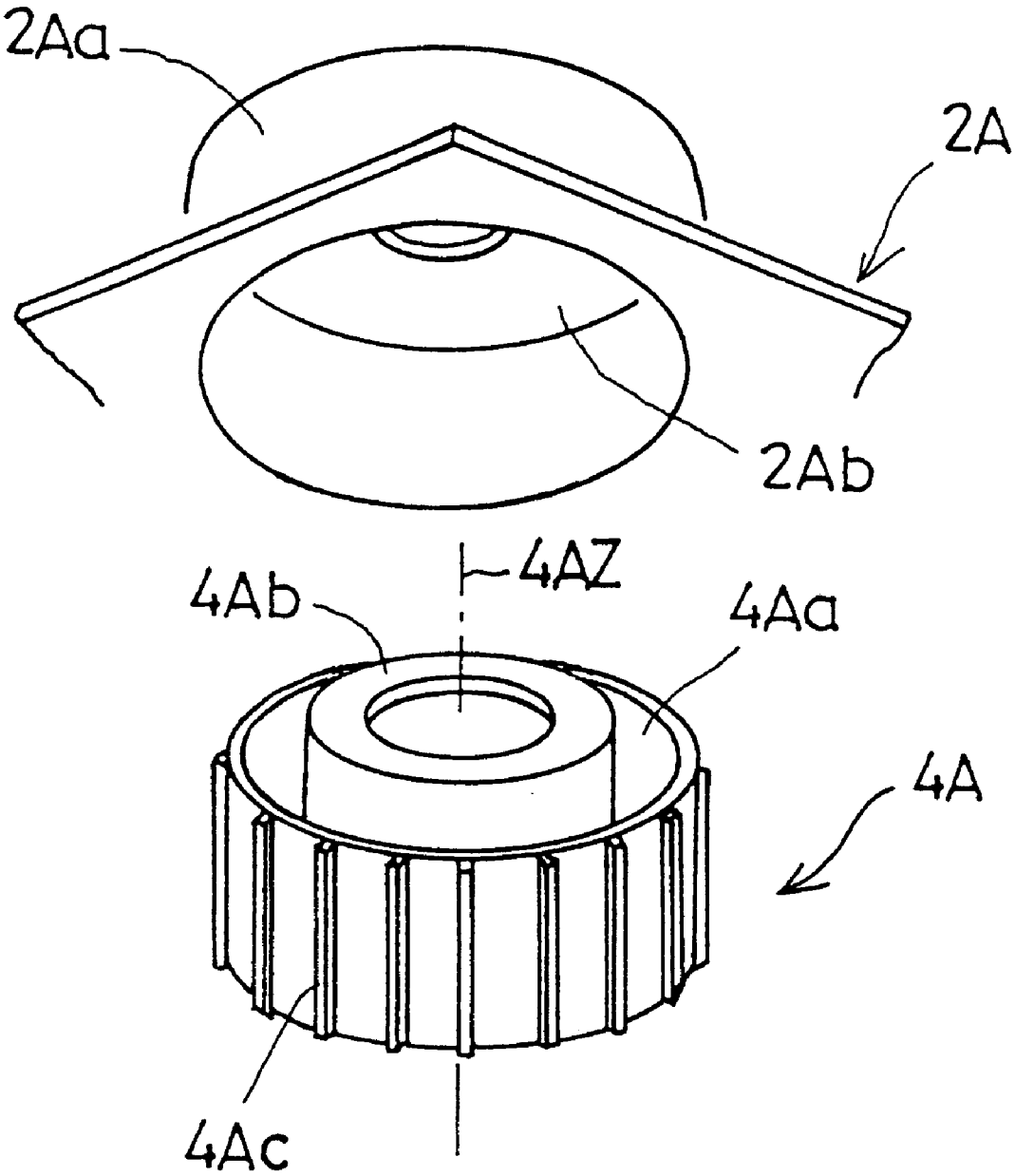
FIG. 14 is a perspective diagram of a slider shown together with a holder.

As shown in FIGS. 12A and 14, the slider 4A has a substantially cylindrical shape. The slider 4A includes a compression-coil-spring accommodation part 4Aa provided at an outer part and having an annular recessed shape, the flange 4Ab provided on the upper surface and having an annular shape and a plurality of ribs 4Ac provided on the peripheral surface. Each of the ribs 4Ac extends in a direction parallel to an axis 4AZ of the slider 4A.

The compression coil spring 3Aa is mounted on the slider 4A with its lower part being fitted into the compression-coil-spring accommodation part 4Aa of the slider 4A. The upper part of the compression coil spring 3Aa is protruded upwards from the slider 4A. Alternatively, the compression coil spring 3Aa may be replaced with the unevenly pitched coil spring 3*c* shown in FIG. 7A.

As shown in FIG. 12A, the slider 4A is fitted with the hemispherical part 124Ab of the stick assembly 123A. Also, the slider 4A is fitted outside the eight bosses 11A. The annular flange 4Ab of the slider 4A is in touch with the upper surfaces of the eight radial protrusions 12.

The slider 4A is fitted in the cylindrical part 2Aa of the cover 2A so as to be slidable in the Z1-Z2 directions. The cover 2A is provided with the annular flange 2Ab protruding inward from the upper end of the cylindrical part 2Aa. The upper end of the compression coil spring 3Aa abuts the backside of the annular flange 2Ab of the cover 2A. The compression coil spring 3Aa is in a slightly compressed state. The slider 4A is held slightly above an upper surface of the housing 8A.

On the backside of the housing 8A, there are recesses 8Ab for accommodating the electromagnetic converting elements 9AX1, 9AX2, 9AY1, and 9AY2.

The structure of the pointing device main-body assembly 121A should be clear from the above descriptions.

The printed-circuit board 10A is provided with the electromagnetic converting elements 9AX1 and 9AX2, which are provided along the X-axis at symmetrically opposite positions about the point OA. Similarly, the electromagnetic converting elements 9AY1 and 9AY2 are provided along the Y-axis at symmetrically opposite positions about the point OA.

The pointing device 120A is completed in the following manner. As shown in FIG. 12A, the pointing device main-body assembly 121A is mounted on the PCB (printed-circuit board) 10A such that the electromagnetic converting elements 9AX1, 9AX2, 9AY1 and 9AY2 are accommodated in the recesses 8Ab. Further, the box-like outer case 122A is mounted so as to cover the pointing device main-body assembly 121A.

The pointing device 120A has the box-like outer case 122A provided with an opening 122Aa which fits with the dome part 1Ab. The key-top main body 1Aa protrudes upward from the outer case 122A. The opening 122Aa of the outer case 122A is provided with a rim 122Ab which covers the peripheral region of the dome part 1Ab.

The above-described pointing device main-body assembly 121A is assembled independently of the printed-circuit board 10A. The pointing device 120A is completed by mounting the pointing device main-body assembly 121A onto the printed-circuit board 10A. Thus, the pointing device 120A is manufactured with an improved efficiency compared to a method of manufacturing a pointing device in which components such as the stick assembly 123A and sliders 4A are assembled onto the printed-circuit board 10A.

When the pointing device 120A is completed and the key-top main body 1Aa is not being operated, the operating part 15A is in an upright position. In the upright position, the compression coil spring 3Aa exerts a spring-force, which presses the slider 4A in a downward direction. The annular flange 2Ab presses the eight protrusions 12A equally in a downward direction. The stick assembly 123A is in a vertical position with the key top 1A being placed at the top.

The magnet 6A in the stick assembly 123A is positioned directly above the point OA of the printed-circuit board 10A, so that each of the magnetoelectric converting elements 9AX1, 9AX2, 9AY1 and 9AY2 is subjected to a magnetic field of equal strength. As will be described later, an output value of the signal processing circuit 127A is 128 counts.

As shown in FIG. 12B, the stick assembly 123A can be inclined so that the slider 4A is upwardly displaced while compressing the compressing coil spring 3Aa. The direction of inclination can be any direction in the X-Y plane. The stick assembly 123A is tilted so as to pivot about the point OA1 (OA2), so that the spherical part 123Aa is pivoted about the point OA1 (OA2) in the bearing part 126A and the hemispherical holder 7A slides in the receiving seat 8Aa. The stick assembly 123A may be tilted until the protrusions 12A come in contact with the rim 2Ac of the cover 2A.

As shown in FIG. 12A, the center of pivotal movement of the stick assembly 123A is not on the lower end surface of the stick assembly 123A but is at a position above the lower end surface by an amount a. Therefore, a range of displacement of the key-top main body 1Aa (range of operation) for tilting the stick assembly 123A through a maximum predetermined angle will be smaller compared to a structure in which the stick assembly is tilted about its lower end which is in contact with the receiving seat. Thus, the pointing device 120A has a reduced size.

As shown in FIG. 12B, the pointing device 120A is operated by a user in such a manner that the user's fingertip 149 is placed on the key-top main body 1Aa so as to tilt the key top 1A in a desired direction. The stick assembly 123A may be tilted in any direction in the following manner. The spherical part 123Aa is pivoted about the point OA1 (OA2) inside the bearing part 126A and one or two of the eight protrusions 12A push up the annular flange 2Ab. The slider 4A is displaced upwardly while compressing the compression coil spring 3Aa.

The hemispherical holder 7A is pressed against the receiving seat 8Aa with a spring force exerted by the compression coil spring 3Aa, and slides in the receiving seat 8Aa. The hemispherical holder 7A is greased so that the holder 7A slides smoothly in the receiving seat 8Aa.

As shown in FIG. 12A, the magnet 6A is positioned slightly below the point OA1. Therefore, as shown in FIG. 12B, the magnet 6A is displaced along an arc having a center at the point OA1. This causes an imbalance of the strength of magnetic field acting on each of the magnetoelectric converting elements 9A. Thus, the signal processing circuit 127A generates a signal corresponding to a direction of operation (direction of inclination) and an angle of inclination of the key-top main body 1Aa.

When the user releases his fingertip 149 from the key-top main body 1Aa, the slider 4A is pressed downward by a spring force of the compression coil spring 3Aa. Then, the annular flange 2Ab presses down the protrusions 12A, which have been displaced in an upward direction, so as to achieve a state in which the eight protrusions 12A are pressed down in an equal manner. Thus, the stick assembly 123A and the key top 1A recover the upright position shown in FIG. 12A.

Referring to FIG. 13B, the pointing device 120A will be described with respect to its resistive force, which differs according to the directions of operation. It can be seen from the figure that there is no protrusion provided in a direction opposite to the X1-direction. In other words, an extended line of the direction X1 passes halfway between protrusions 12A1, 12A2. In FIG. 13B, the protrusion 12A1 is provided in a direction opposite to a direction B.

When the stick assembly 123A is operated so as to tilt in the B-direction, the protrusion 12A1 pushes up the slider 4A. When the stick assembly 123A is operated so as to tilt in the X1-direction, the protrusions 12A1 and 12A2 will push up the slider 4A. Now, the height of a tip of the protrusion 12A1 (12A2) will be compared between cases where the stick assembly 123A is inclined through the same angle but in different directions. The tip of the protrusion 12A1 (12A2) will be at a slightly higher level when the stick assembly 123A is inclined in the B-direction than when inclined in the X1-direction. Therefore, when the stick assembly 123A is to be tilted in the B-direction, a greater operational force is required compared to a case where the stick assembly 123A is to be inclined in the X1-direction. Thus, from such a difference in the operational force, the user can recognize the direction of operation of the pointing device 120A.

In FIG. 13B, arrows 151 indicate directions in which less operational force is required and thus operability is improved.

In the following, advantageous points of the above-described pointing device 120A and the pointing-device main-body assembly 121A will be described.

First, the pointing device 120A and the pointing-device main body 121A can be operated with a reduced operational force. As shown in FIG. 14, the slider 4A and the cylindrical part 2Aa of the cover 2A are provided such that the plurality of the ribs 4Ac on the peripheral surface of the slider 4A are in contact with the inner surface of the cylindrical part 2Aa. Thus, the slider 4A and the cylindrical part 2Aa of the cover 2A are in line contact, rather than in surface contact. This reduces the friction caused by the slider 4A sliding upward inside the cylindrical part 2Aa of the cover 2A as compared to a case of surface contact. Thus, the key top 1A can be operated with less operational force and thus operability is improved.

Secondly, the key-top main body 1Aa is prevented from slipping out. As shown in FIGS. 12A and 12B, the rim 122Ab of the outer case 122A covers the peripheral part of the dome part 1Ab. Therefore, even if the key-top main body 1Aa is pulled upwards with a strong force, the outer case 122A prevents the key top 1A from falling off of the stick 124A.

Thirdly, the key-top 1A is prevented from being rotated. As shown in FIGS. 11, 12A, 12B and 13A to 13C, the key-top main body 1Aa and the stick 124A are connected by the fitting recess 1Ac having a rectangular opening and the columnar part 124Aa1 being fitted together. Thus, the key top 1A is prevented from being rotated with respect to the stick 124A. Also, the protrusions 12A on the stick assembly 123A are each positioned between the neighboring bosses 11A, so that the stick assembly 123A is prevented from rotating with respect to the housing 8A.

Therefore, even if the user attempts to rotate the key top 1A about the Z-axis, the protrusions 12A will abut the bosses 11A, so that the key top 1A is prevented from being rotated. This structure is particularly useful when the key top 1A has a given orientation, which may be indicated by indications provided on an upper surface of the key-top main body 1Aa.

Fourthly, the key-top main body 1Aa does not break even if rotated with a strong force. As has been described above, the key top 1A is prevented from being rotated by means of the protrusions 12A and the bosses 11A. However, there may be a case where a greater force is exerted on the key-top main body 1Aa. Since the boss 11A is made of an elastomeric material, as shown in FIG. 13C, when the protrusion 12A presses the upper part of the boss 11A, the boss 11A will bend, as shown by a dash-dot line, and then will recover its original shape. Thus, although the protrusion 12A is displaced beyond the boss 11A and the key-top main body 1Aa is rotated by a small amount, it is possible to avoid the breakage of the boss 11A and the key-top main body 1Aa.

Finally, it is possible to prevent any contaminants from entering inside the outer casing 122A. As shown in FIGS. 12A and 12B, the opening 122Aa of the outer case 122A is blocked by the dome part 1Ab. Thus, the contaminants are prevented from entering inside the outer case 122A.

In the following, the signal processing circuit 127A will be described.

Figure 15:
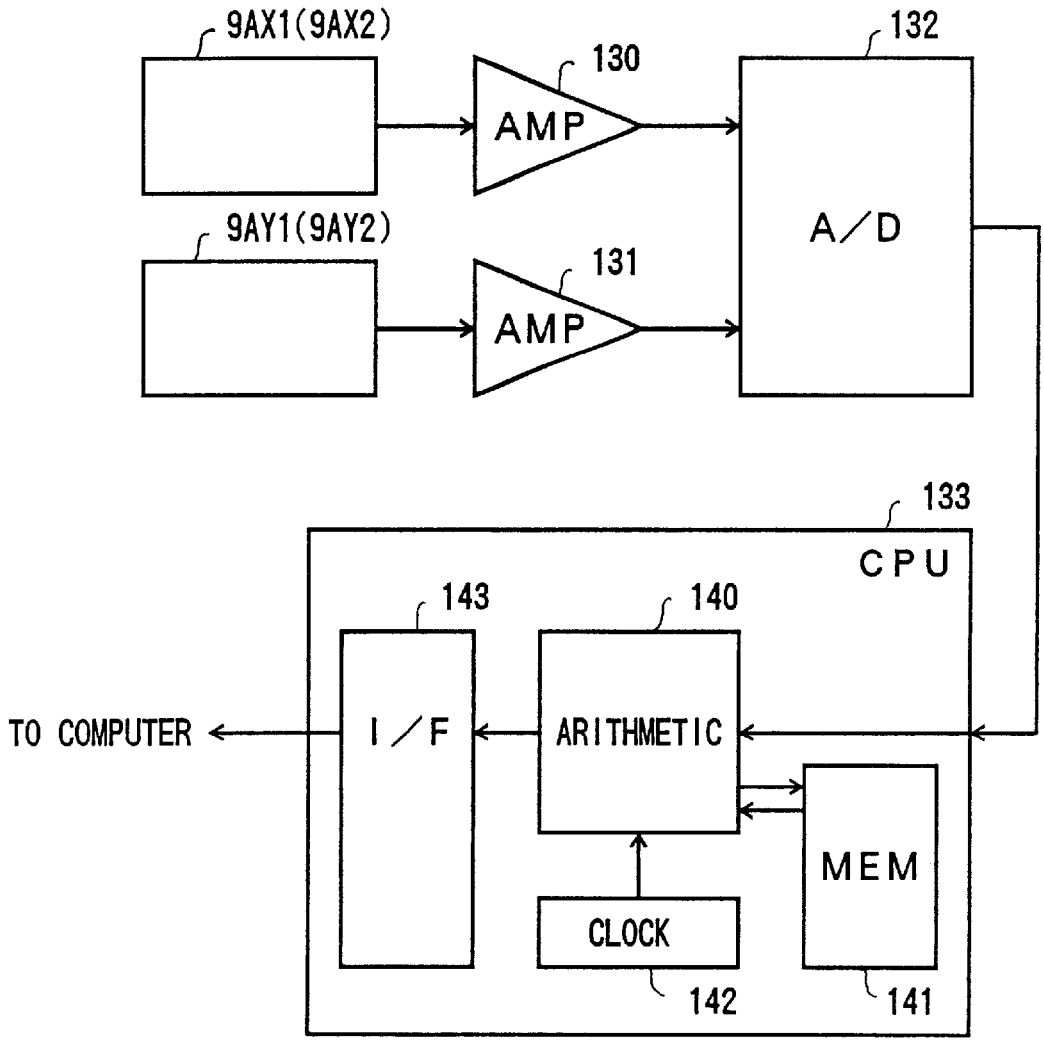
FIG. 15 is a block diagram illustrating a signal processing circuit shown in FIG. 11.

As shown in FIG. 15, the signal processing circuit 127A includes two amplifiers 130, 131, an A/D converter 132 and a central processing unit (CPU) 133. The CPU 133 includes an arithmetic unit 140, a storage unit 141, a clock unit 142 and an interface unit 143.

The amplifier 130 differentially amplifies output voltages of the two electromagnetic converting elements 9AX1, 9AX2 provided along the X-axis. The amplifier 131 differentially amplifies output voltages of the two electromagnetic converting elements 9AY1, 9AY2 provided along the Y-axis. The amplified voltages are converted at the A/D converter 132 and then applied to the CPU 133. In the CPU 133, the converted data is compared with the data in the storage unit 141 in synchronous with the clock. Then the converted data is converted into a computer recognizable form at the interface unit 143 and then is output to a computer.

Figures 16, 17:
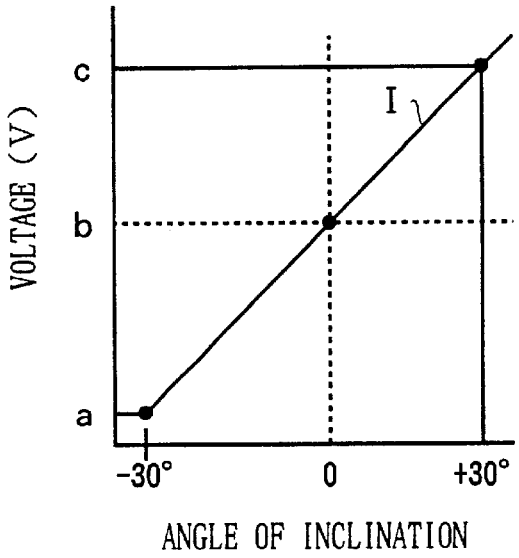
FIG. 16 is a diagram showing a graph of an output voltage (V) against an angle of inclination of a key-top main body.
FIG. 17 is a diagram showing a chart of voltages and output values of a CPU.

FIG. 16 is a diagram showing a graph of an output voltage (V) differentially amplified at the amplifier 130 against an angle of inclination of the key-top main body 1Aa, when the key-top main body 1Aa is inclined in the X-Z plane. As can be seen from the graph, when the angle of inclination is zero, the voltage is b (V). As indicated by a line 1, the voltage varies linearly with the angle of inclination. In the given example, the voltage a (V) is output when the angle of inclination is −30 degrees and the voltage c (V) is output when the angle of inclination is +30 degrees.

FIG. 17 is a diagram showing a chart of a voltage and an output value of the CPU 133. For instance, output values of the CPU 133 are 1 count, 128 counts and 256 counts at the voltages of a (V), b (V) and c (V), respectively.

Figure 18:
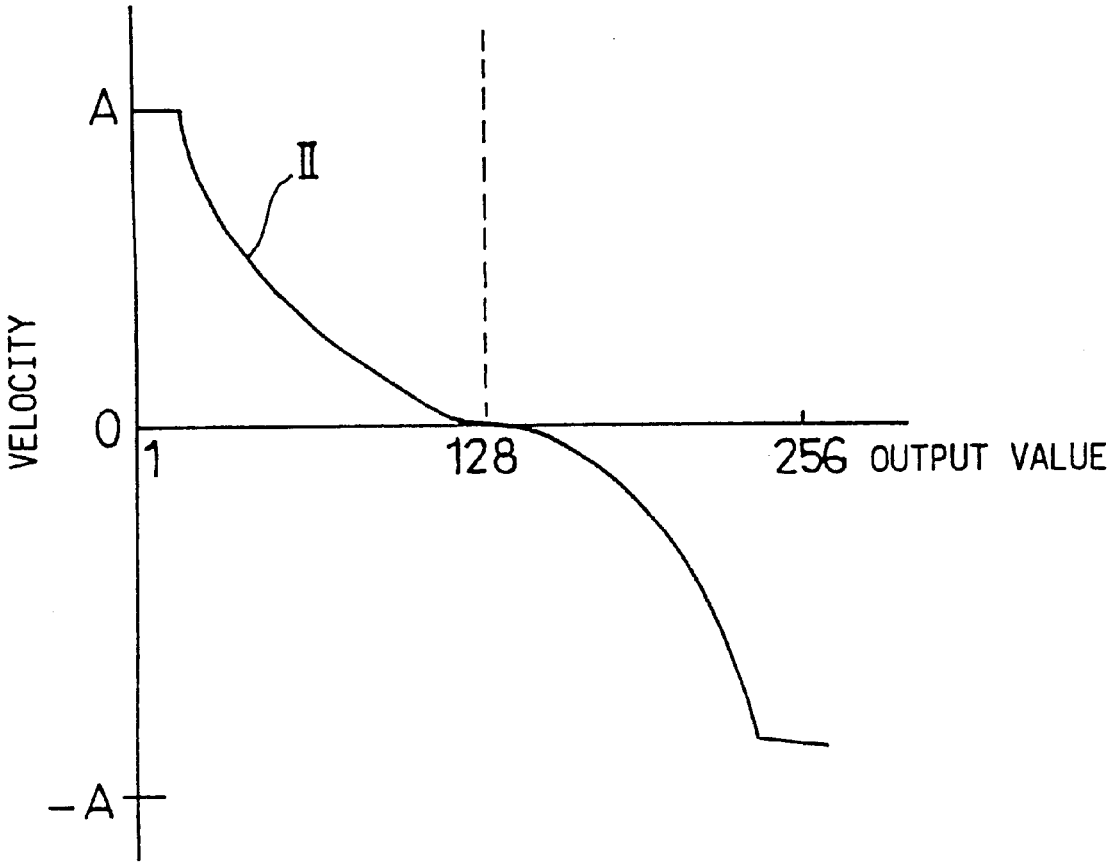
FIG. 18 is a diagram showing a graph of a velocity of a cursor against an output value of the CPU.

FIG. 18 is a diagram showing a graph of a velocity of a cursor on the display screen against an output value of the CPU 133. As can be seen from line 11, the cursor moves with a velocity A when the output value is 1 count and the cursor does not move when the output value is 128 counts. When the output count is 256 counts, the cursor moves in a velocity having the same magnitude but an opposite direction to that in the case of an output value of 1 count.

Also, the direction of inclination of the key-top main body 1Aa is determined at the CPU 133 based on the ratio between an output voltage of the amplifier 130 and an output voltage of the amplifier 131.

Thereby, by operating the key-top main body 1Aa, the cursor on the display screen moves with a velocity having a direction corresponding to an angle of inclination of the key-top main body 1Aa.

In the following, variants of the pointing device of the second embodiment of the present invention will be described.

Figure 19:
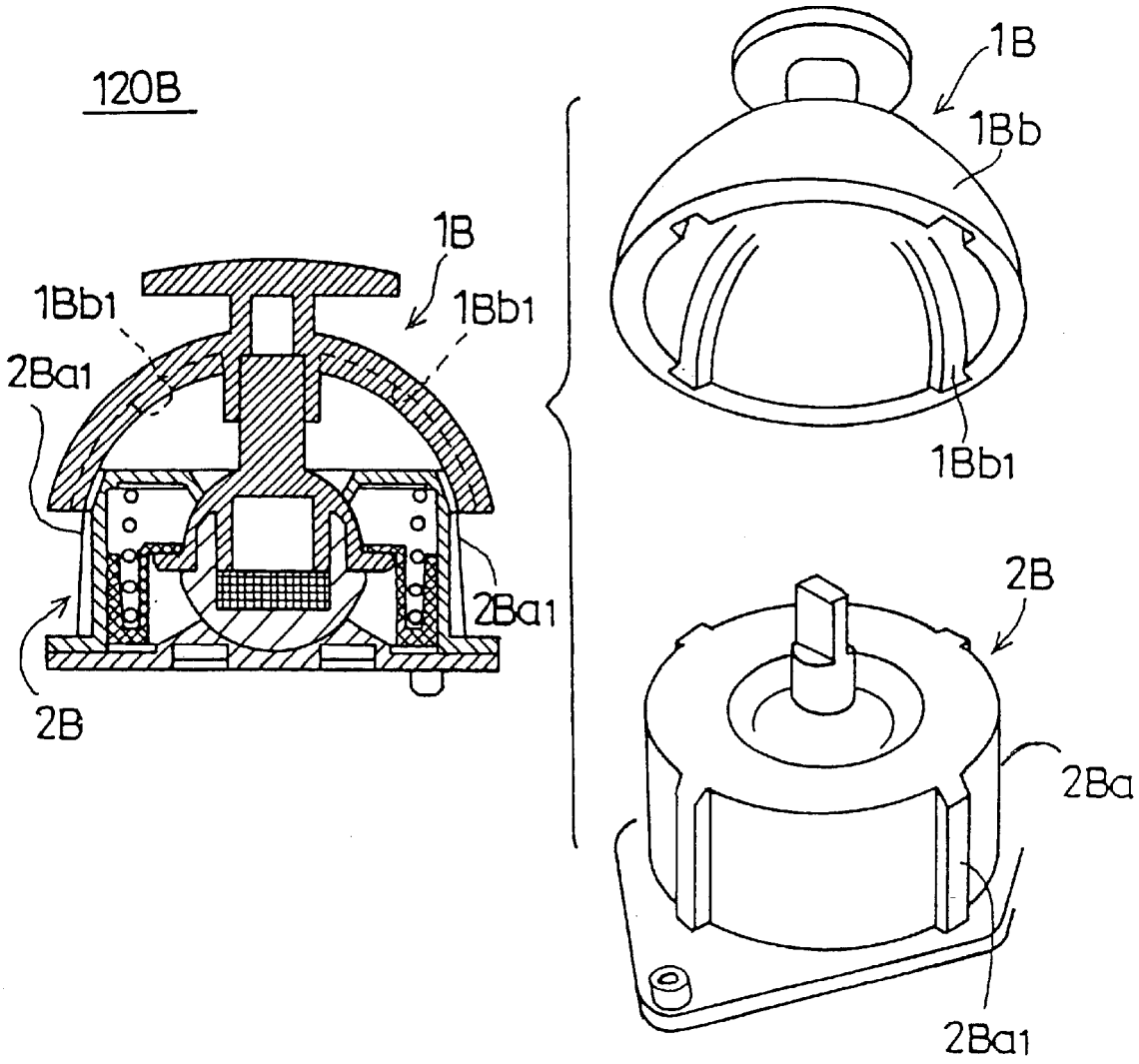
FIG. 19 is a diagram showing a pointing device of a first variant of the second embodiment of the present invention.

FIG. 19 is a diagram showing a pointing device 120B of a first variant of the second embodiment of the present invention. A key top 1B has a hemispherical dome part 1Bb provided with grooves 1Bb1 on its inner surface. A cover 2B is provided with longitudinal ribs 2Ba1 on a peripheral surface of a cylindrical part 2Ba. The grooves 1Bb1 and the ribs 2Ba1 are provided at 90 degree intervals in a peripheral direction. The key top 1B is attached to the cover 2B with the grooves 1Bb1 being fitted to the corresponding ones of the ribs 2Ba1. Thus, the key top 1B is prevented from being rotated with respect to the cover 2B at four locations corresponding to the grooves 1Bb1.

Figure 20:
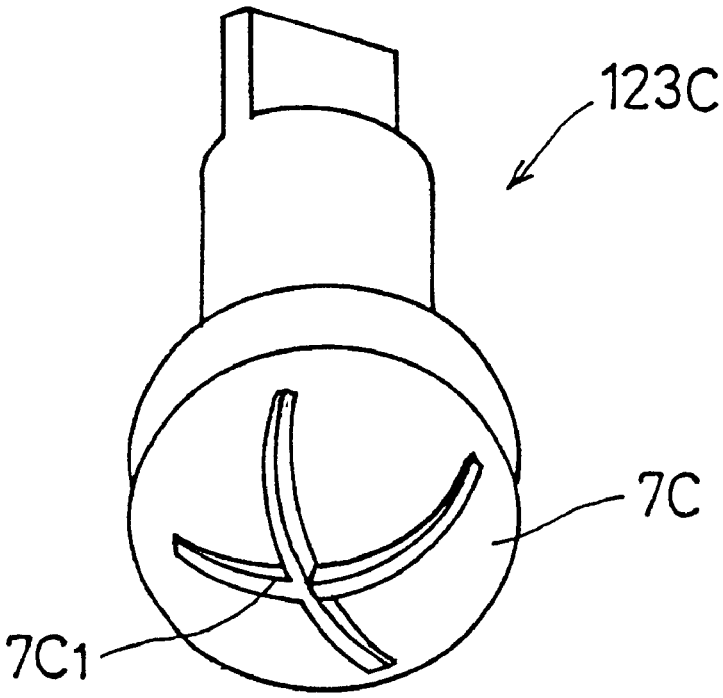
FIG. 20 is a diagram showing a holder and a housing of a pointing device of a second variant of the second embodiment of the present invention.
Figure 20:
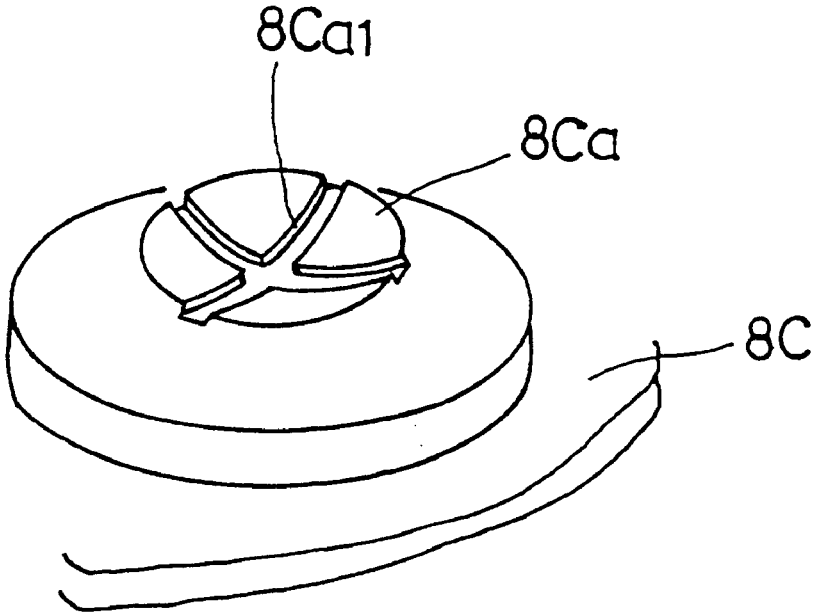

FIG. 20 is a diagram showing a holder and a housing of a pointing device of a second variant of the second embodiment of the present invention. A stick assembly 123C has a hemispherical holder 7C provided with cross-shaped ribs 7C1. A housing 8C has a receiving seat 8Ca provided with cross-shaped grooves 8Ca1 on its concave surface. The holder 7C is supported by the receiving seat 8Ca with the ribs 7C1 being fitted in the grooves 8Ca1. Thus, the stick assembly 123C (and thus a key top mounted there on) is prevented from being rotated with respect to the housing 8C.

Figure 21:
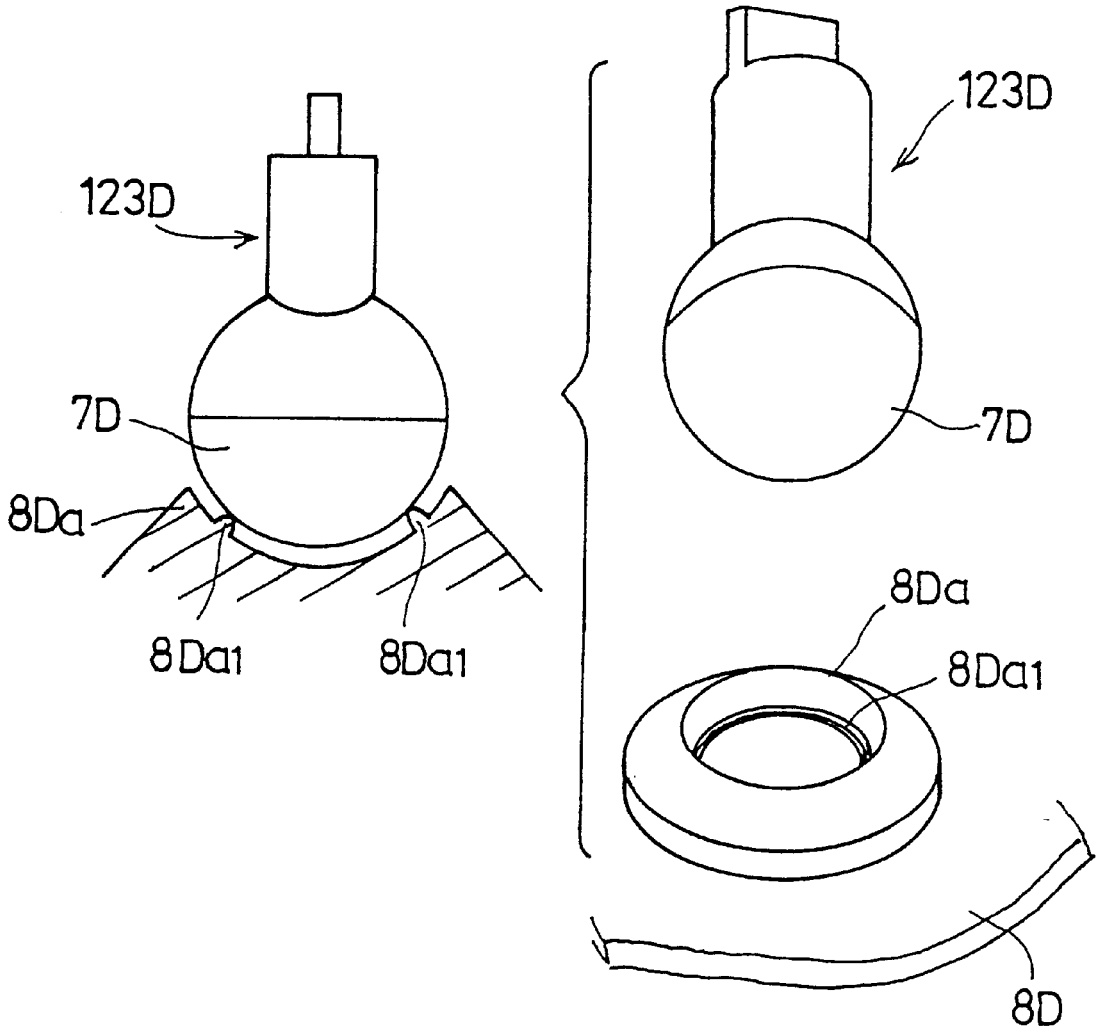
FIG. 21 is a diagram showing a holder and a housing of a pointing device of a third variant of the second embodiment of the present invention.

FIG. 21 is a diagram showing a holder and a housing of a pointing device of a third variant of the second embodiment of the present invention. A housing 8D has a receiving seat 8Da provided with an annular raised part 8Da1 on its concave surface. A raised part 8Da1 has a semicircular cross section. The holder 7D is supported by the receiving seat 8Da at the annular raised part 8Da1.

A stick assembly 123D is inclined in such a manner that the holder 7D slides on the annular raised part 8Da1. Therefore, the contact between the holder 7D and the receiving seat 8Da will be a line contact which results in less friction compared to a surface contact. Thus, less operational force is required for tilting the key-top main body and the pointing device has an improved operability.

Figure 22:
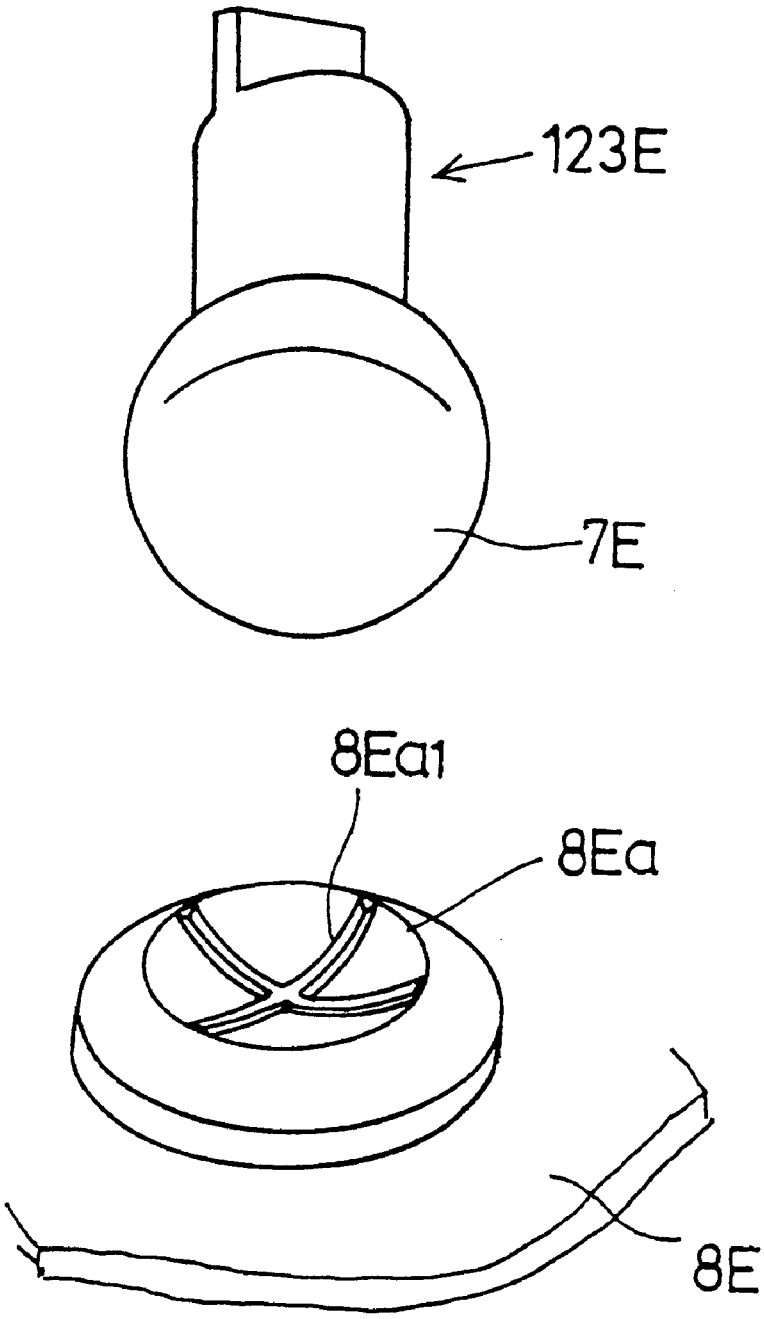
FIG. 22 is a diagram showing a holder and a housing of a pointing device of a fourth variant of the second embodiment of the present invention.

FIG. 22 is a diagram showing a holder and a housing of a pointing device of a fourth variant of the second embodiment of the present invention. A housing 8E has a receiving seat 8Ea provided with a cross-shaped raised part 8Ea1 on its concave surface instead of the annular raised part 8Da1 shown in FIG. 21. The raised part 8Ea1 has a semicircular cross-section.

A stick assembly 123E is inclined in such a manner that a holder 7E slides on the cross-shaped raised part 8Ea1. The holder 7D and the receiving seat 8Da are in line contact which each other. Thus, less operational force is required for tilting the key-top main body and the pointing device has an improved operability.

Figure 23:
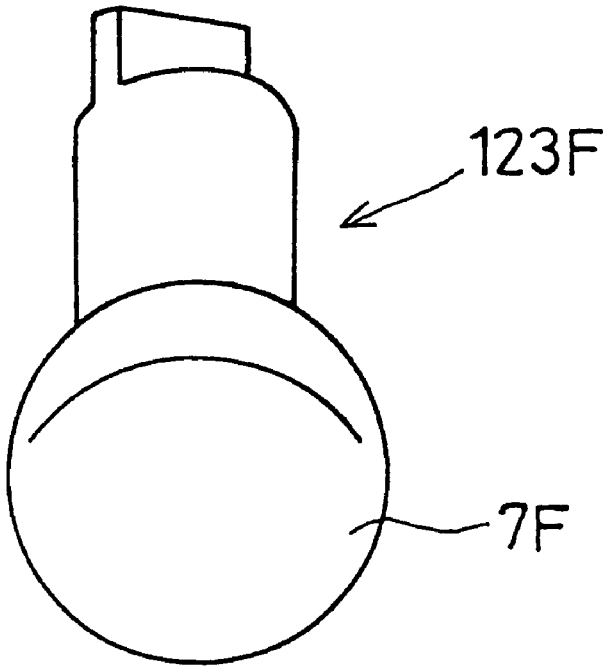
FIG. 23 is a diagram showing a holder and a housing of a pointing device of a fifth variant of the second embodiment of the present invention.
Figure 23:
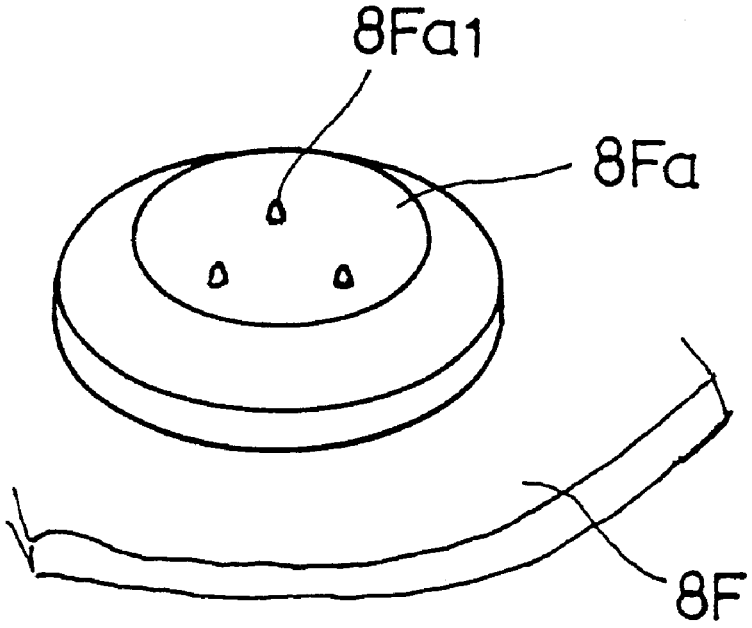

FIG. 23 is a diagram showing a holder and a housing of a pointing device of a fifth variant of the second embodiment of the present invention. A housing 8F has a receiving seat 8Fa provided with three hemispherical protruded parts 8Fa1 on its concave surface instead of the annular raised part 8Da1 shown in FIG. 21. The hemispherical protruded parts 8Fa1 are provided at equal intervals in a peripheral direction.

A stick assembly 123F is inclined in such a manner that a holder 7F slides on the protruded parts 8Fa1. The holder 7F and the receiving seat 8Fa are in point contact which each other. Thus, less operational force is required for tilting the key-top main body and the pointing device has an improved operability.

Figure 24:
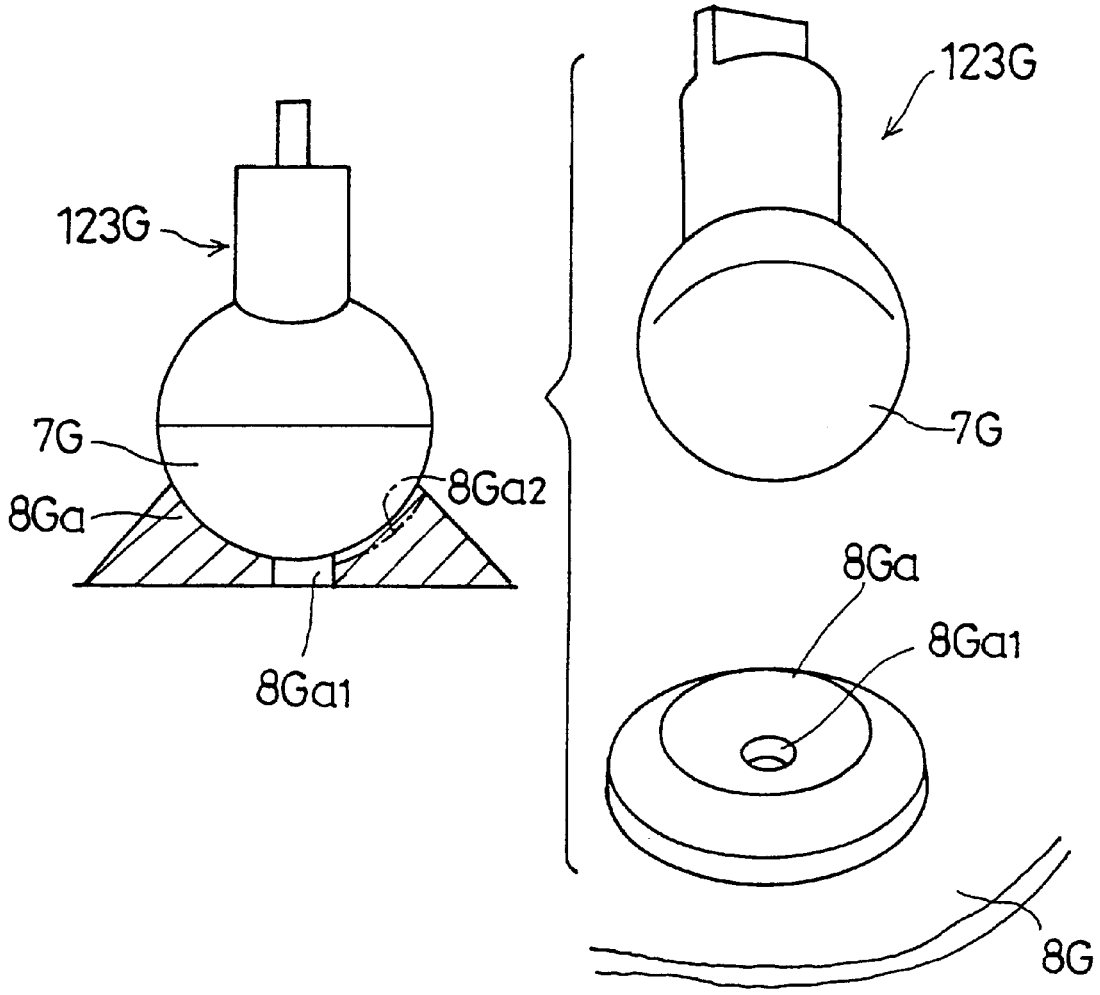
FIG. 24 is a diagram showing a holder and a housing of a pointing device of a sixth variant of the second embodiment of the present invention.

FIG. 24 is a diagram showing a holder and a housing of a pointing device of a sixth variant of the second embodiment of the present invention. If there is any contaminant between the receiving seat 8Ga and a holder 7G, the holder 7G cannot slide smoothly. This can cause a reduction in an operability of the pointing device.

In order to obviate such a drawback, a housing 8G is provided with an opening 8Ga1 at the deepest position of the concave surface of the receiving seat 8Ga. The contaminant having entered on the concave surface of the receiving seat 8Ga will be gathered into the opening 8Ga1 by operations of a stick assembly 123G. Thus, the contaminant is removed from the concave surface of the receiving seat 8Ga and the pointing device can maintain its good operability.

Also, as shown in FIG. 24 in a dash-dot line, grooves 8Ga2 may be provided instead of the opening 8Ga1.

Figure 25:
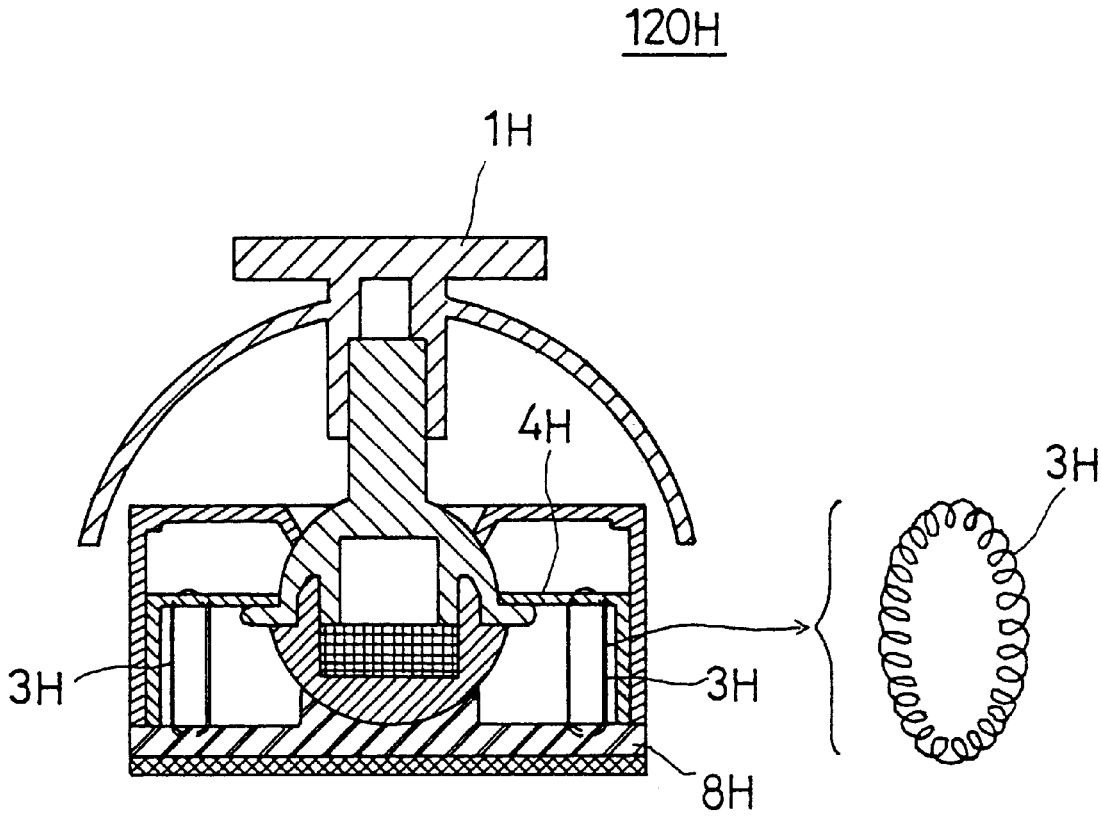
FIG. 25 is a diagram showing a pointing device of a seventh variant of the second embodiment of the present invention.

FIGS. 25 and 26 are diagrams showing seventh and eighth variants of the second embodiment of the present invention in which variants of the compression coil spring 3Aa are used.

FIG. 25 is a diagram showing a pointing device 120H of a seventh variant of the second embodiment of the present invention. The pointing device 120H is provided with garter springs 3H hooked between a slider 4H and a housing 8H. The garter spring 3H is a ring-shaped coil spring and is used in place of the compression coil spring 3Aa. The slider 4H is biased in a downward direction with a spring force of the garter springs 3H.

Figure 26A:
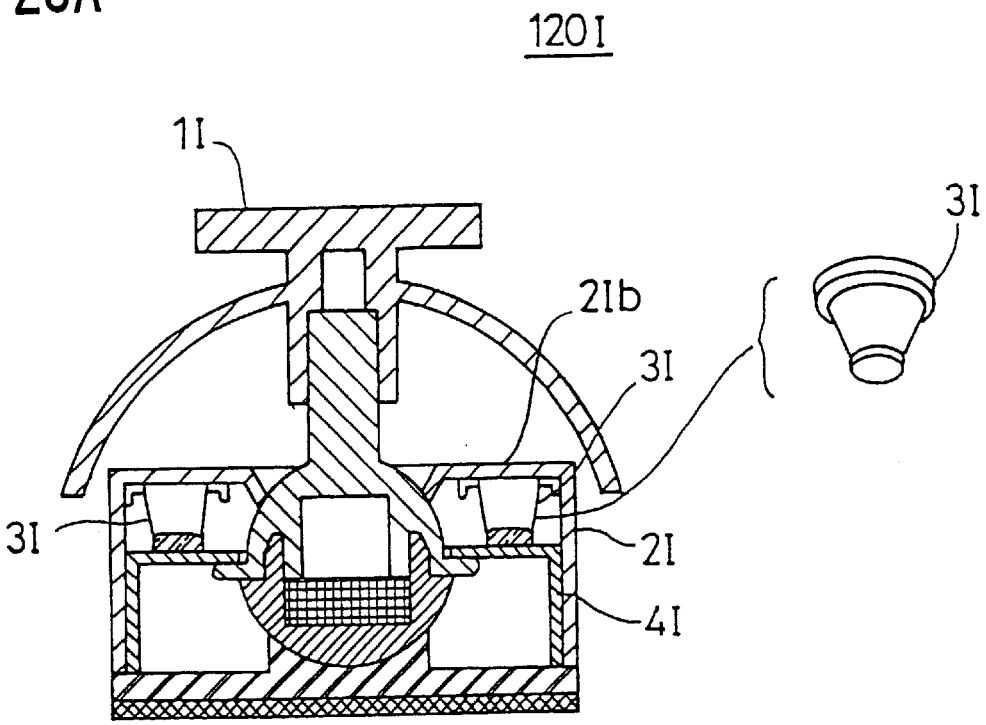
FIG. 26A is a diagram showing a pointing device of an eighth variant of the second embodiment of the present invention and FIG. 26B is a rubber spring used in the pointing device shown in FIG. 26A.
Figure 26B:
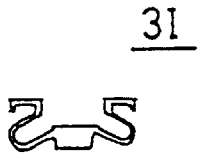

FIG. 26A is a diagram showing a pointing device of an eighth variant of the second embodiment of the present invention and FIG. 26B is a rubber spring used in the pointing device shown in FIG. 26A. The pointing device 120I is provided with dome-shaped rubber springs 31 between a slider 41 and a flange 21*b* of a cover 21 instead of the compression coil spring 3Aa. The slider 41 is biased in a downward direction with a spring force of the rubber spring 31. When the key top 11 is operated, the dome-shaped rubber spring 31 is elastically deformed as shown in FIG. 26B, and thus the slider 41 is biased in a downward direction.

Figure 27:
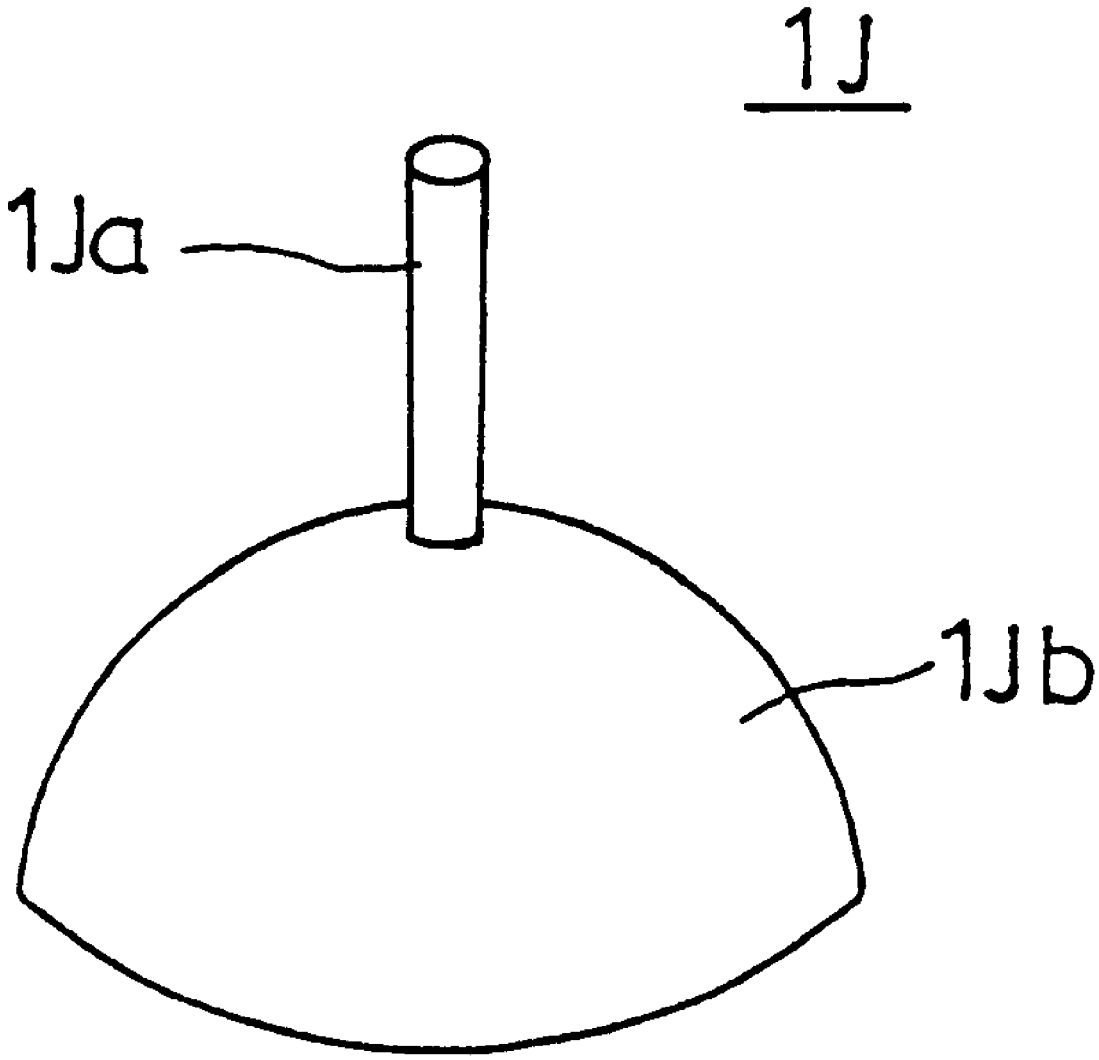
FIG. 27 is a diagram showing a key top of a pointing device of a ninth variant of the second embodiment of the present invention.

FIG. 27 is a diagram showing a key top of a pointing device of a ninth variant of the second embodiment of the present invention. A key top 1J is provided with a stick part 1Ja protruding upward from a hemispherical dome part 1Jb. The user operates the key-top 1J by pinching the stick part 1Ja with his fingertips.

Figure 28A:
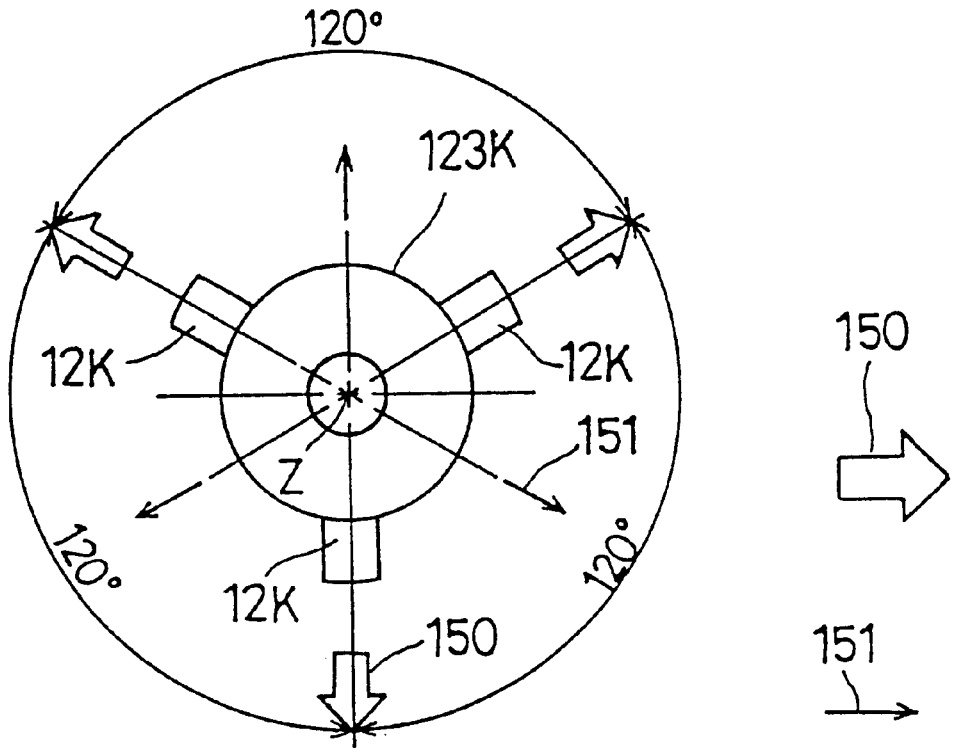
FIGS. 28A and 28B are diagrams showing a stick assembly of a pointing device of a tenth variant of the second embodiment of the present invention.
Figure 28B:
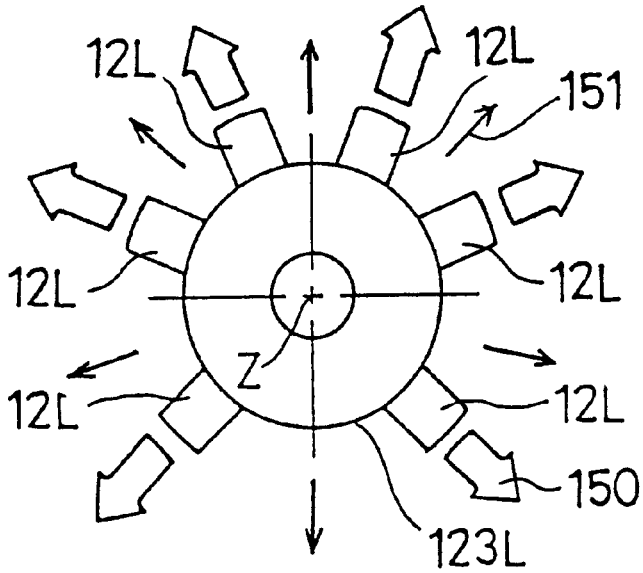

FIGS. 28A and 28B are diagrams showing a stick assembly of a pointing device of a tenth variant of the second embodiment of the present invention. FIG. 28A shows a structure in which three protrusions 12K are provided at equal angular intervals in radial directions perpendicular to the Z-axis. FIG. 28B shows a structure in which six protrusions 12L are provided in radial directions at unequal angular intervals.

Thick arrows 150 indicate directions in which greater operational force is required for tilting the stick assemblies 123K, 123L. Thin arrows 151 indicate directions in which less operational force is required for tilting the stick assemblies 123K, 123L.

Figure 29:
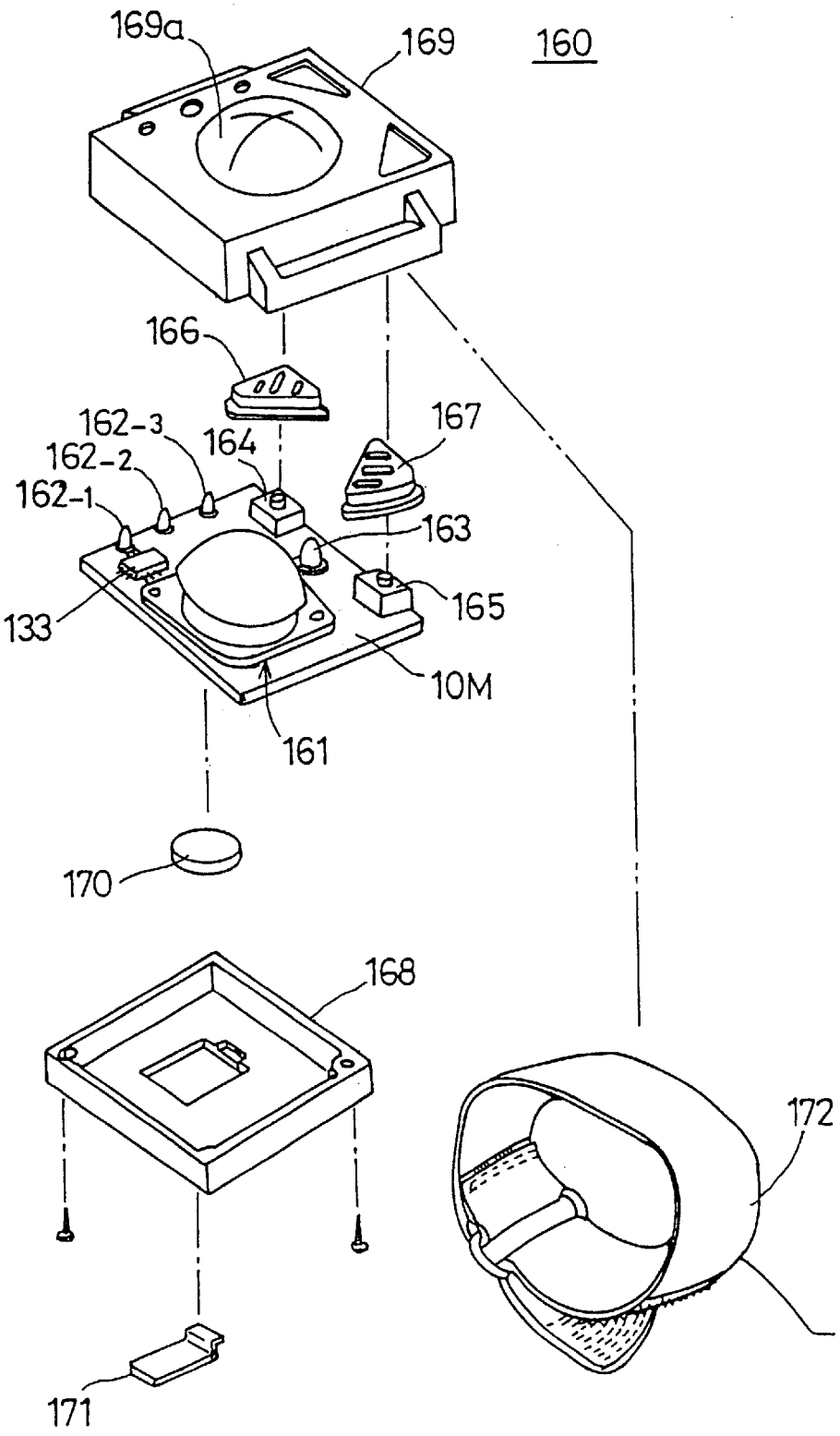
FIG. 29 is an exploded view showing an input device of a third embodiment of the present invention, embodied as an acceleration-measuring apparatus.
Figure 30:
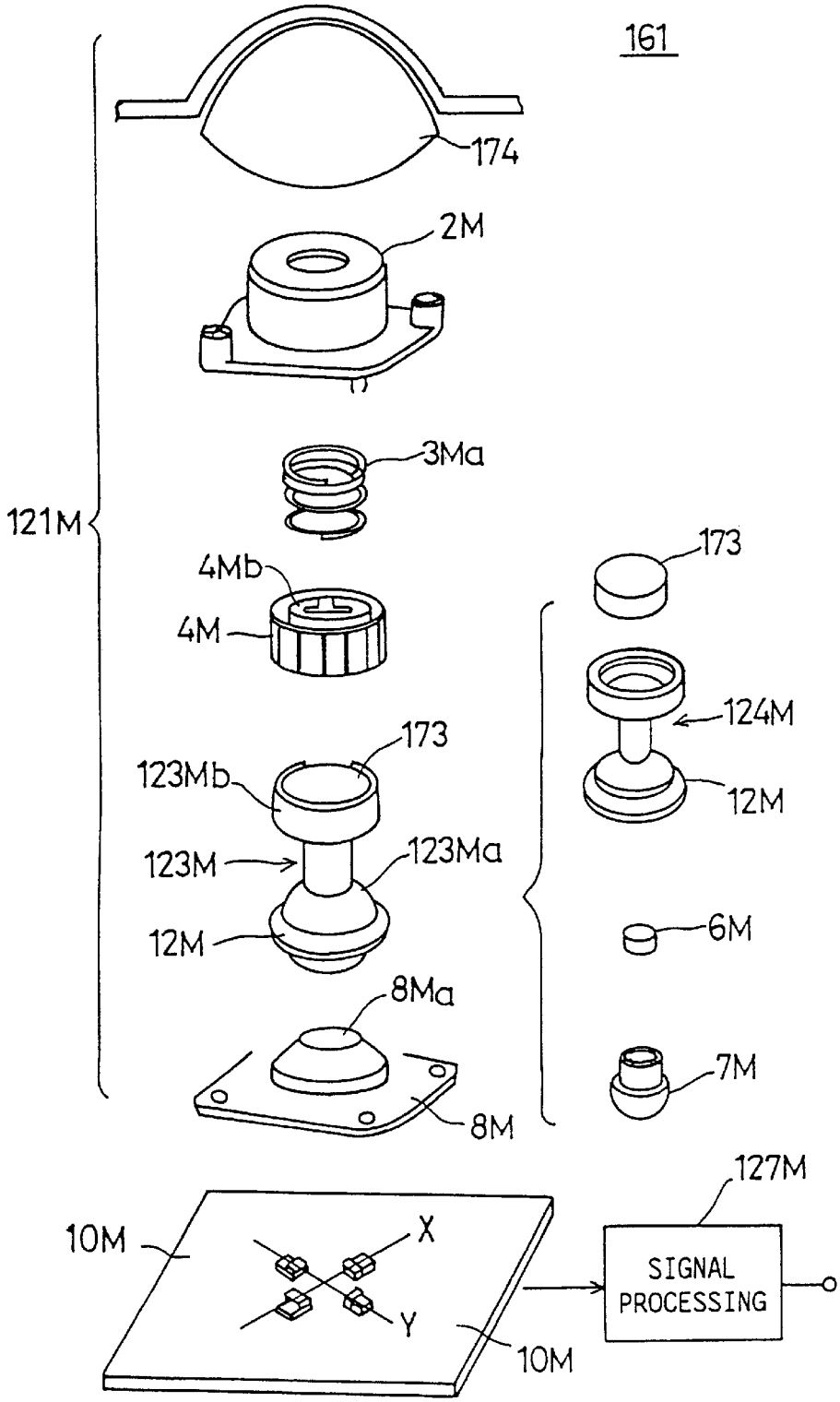
FIG. 30 is an exploded view showing an acceleration-detecting device shown in FIG. 29.
Figure 31A:
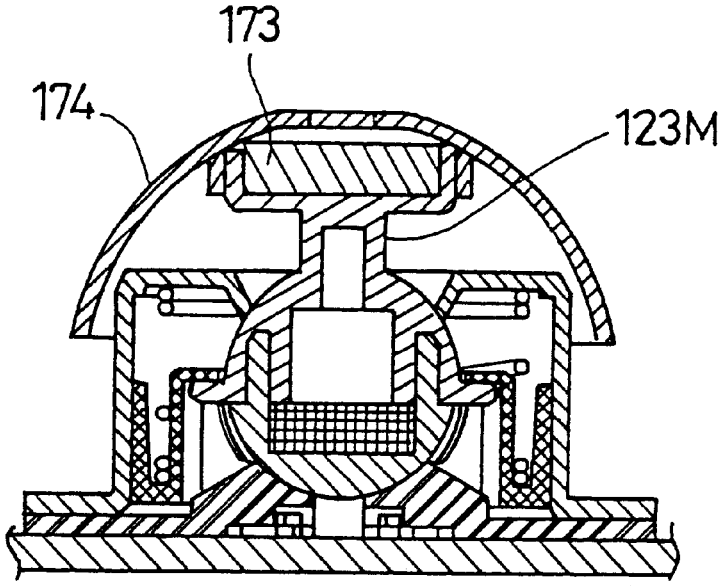
FIGS. 31A and 31B are cross-sectional diagrams showing the acceleration-detecting device of the third embodiment of the present invention in an upright position and in a tilted position, respectively.
Figure 31B:
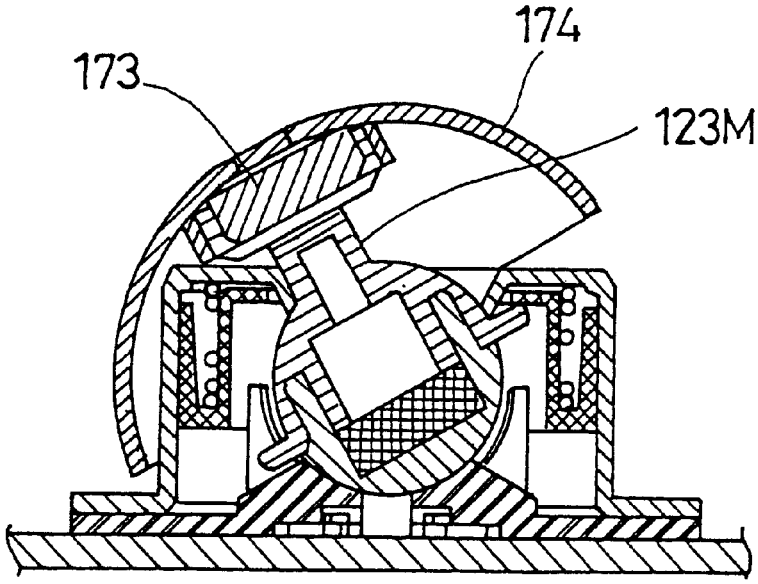

FIG. 29 is an exploded view showing an input device of a third embodiment of the present invention, embodied as an acceleration-measuring apparatus 160. FIG. 30 is an exploded view showing an acceleration-detecting device 161 shown in FIG. 29. FIGS. 31A and 31B are cross-sectional diagrams showing the acceleration-detecting device 161 in an upright position and in a tilted position, respectively.

FIG. 29 shows the acceleration-measuring apparatus 160 having a printed-circuit board 10M provided with the acceleration-detecting device 161, the CPU 133, LEDs 162-1 to 162-3, an infrared communication unit 163, an acceleration measuring start switch 164 and a measurement data transfer start switch 165. Further, key-tops 166 and 167 are mounted on the switches 164 and 165, respectively, and are accommodated within a lower cover 168 and an upper cover 169. The lower and upper covers 168 and 169 are fastened by means of screws. A button-type battery 170 is accommodated at the backside of the printed-circuit board 10M and is covered by a lid 171.

Figure 34:
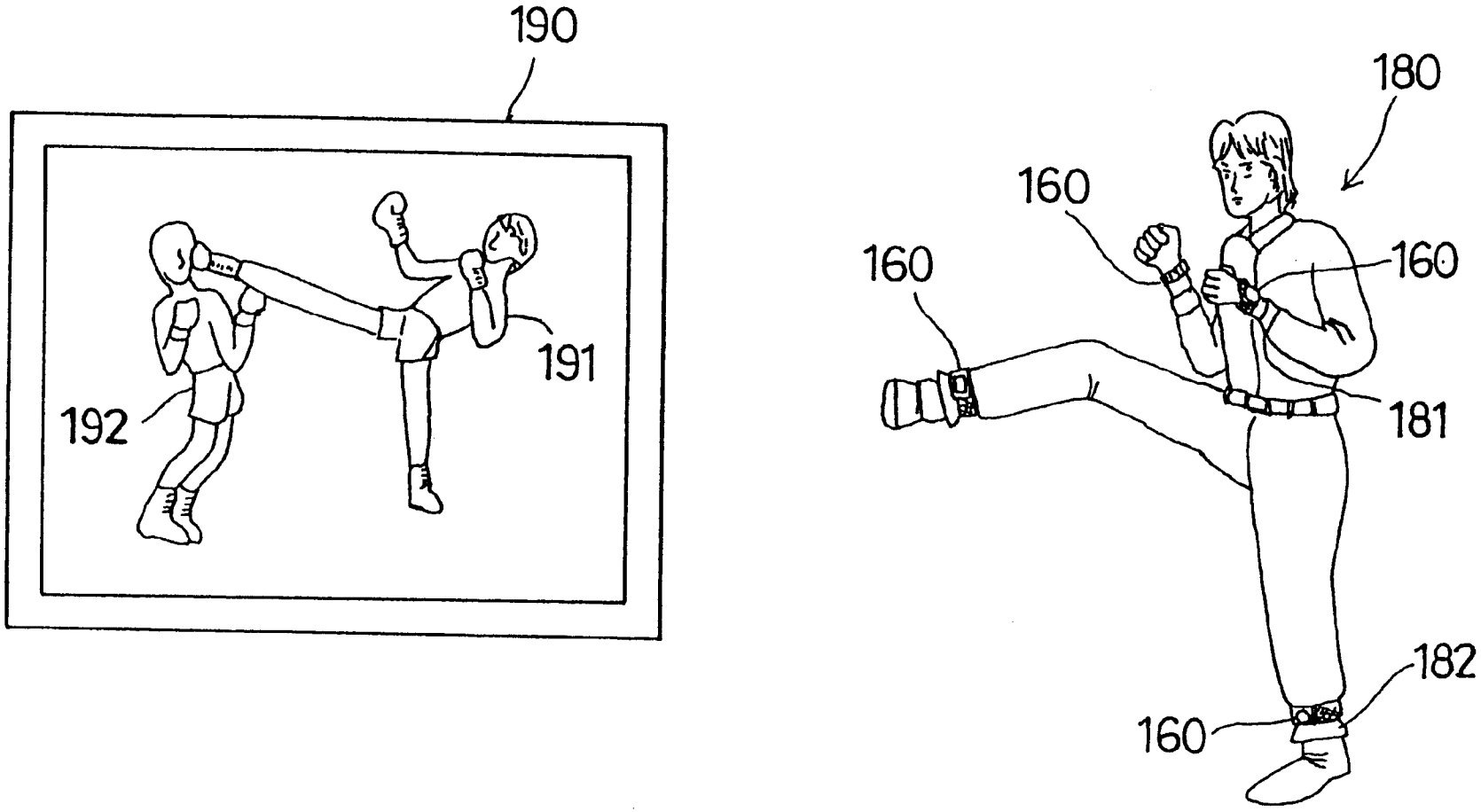
FIG. 34 is a diagram showing an example of application of the acceleration-measuring apparatus of the third embodiment of the present invention.

Further, the acceleration-measuring apparatus 160 may be attached to a belt 172. Thus, as shown in FIG. 34, a player 180 of a game may be equipped with the acceleration-measuring apparatus 160 on his wrists 181 and ankles 182.

The acceleration-detecting device 161 differs from the pointing-device main-body assembly 121A of FIG. 11 in that, instead of the key-top 1A, a disk-shaped weight 173 is provided inside a cup-shaped part 123 Mb at the top end of a stick assembly 123M. Further, a dome-shaped cover 174 is provided so as to cover the weight 173. The dome-shaped cover 174 opposes a dome-shaped transparent window 169*a* of the upper cover 169.

The stick assembly 123M is provided with an annular flange 12M instead of the protrusions 12A in FIG. 11. The upper surface of the annular flange 12M receives an annular flange 4Mb of the slider 4M. When the stick assembly 123M is tilted, the annular flange 12M pushes up the annular flange 4Mb of the slider 4M. Therefore, the resistive force exerted on the stick assembly 123M is equal in all direction. In other word, the acceleration-detecting device 161 does not have a particular orientation. Thus, the acceleration-detecting device 161 is capable of accurately measuring accelerations in any direction in the X-Y plane.

The housing 8M does not include bosses equivalent to the bosses 11A. Therefore, the stick assembly 123M may be rotated about its axis (Z). However this does not cause any inconvenience. Here, the disk-shaped magnet magnetized in the direction of thickness is provided at a position on the axis (Z-axis) of the stick assembly 123M. Therefore, even if the stick assembly 123M is rotated about its axis (Z-axis), there will be no effect in detecting acceleration.

Apart from the above-described points, the acceleration-detecting device 161 has a similar structure to that of the pointing-device main-body assembly 121A of FIG. 11. In FIGS. 30, 31A and 31B, similar components to those shown in FIG. 11 is shown by similar reference numerals and further description is omitted.

The stick assembly 123M can be inclined in any direction through 360 degrees (any two dimensional direction in the X-Y plane). Then, the slider 4M is upwardly displaced while compressing the compressing coil spring 3Ma. Therefore, when an acceleration acts on the weight 173, as shown in FIG. 31B, the stick assembly 123M will be tilted in a direction of the acceleration through an angle corresponding to a magnitude of the acceleration.

Figure 32:
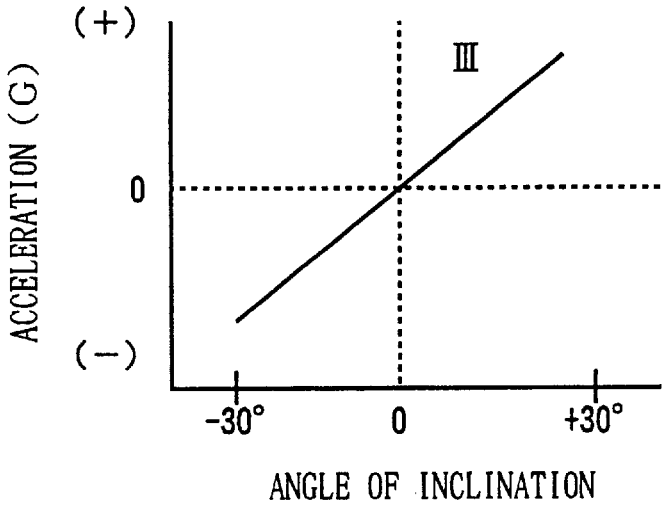
FIG. 32 is a diagram showing a graph of an acceleration (G) against an angle of inclination of a key-top main body.

FIG. 32 is a diagram showing a graph of an acceleration (G) against an angle of inclination of a key-top main body. As indicated by a line III, the angle of inclination of the stick assembly 123M varies linearly against the acceleration acting on the weight 173. Since the annular flange 12M is in contact with the annular flange 4Mb of the slider 4M, the angle of inclination of the stick assembly 123M varies linearly against the acceleration acting on the weight 173 in any two dimensional direction in the X-Y plane. When the acceleration acting on the weight 173 is reduced and finally becomes zero, the stick assembly 123M recovers its upright position shown in FIG. 31A by the spring force of the compression coil spring 3Ma.

The signal processing circuit 127M is identical to the signal processing circuit 127A shown in FIG. 15. Here, the CPU 133 executes a process for detecting the acceleration.

When there is acceleration acting on the acceleration-measuring apparatus 160, as shown in FIG. 32, the angle of inclination of the stick assembly 123M varies linearly with the acceleration acting on the weight 173.

Figure 33:
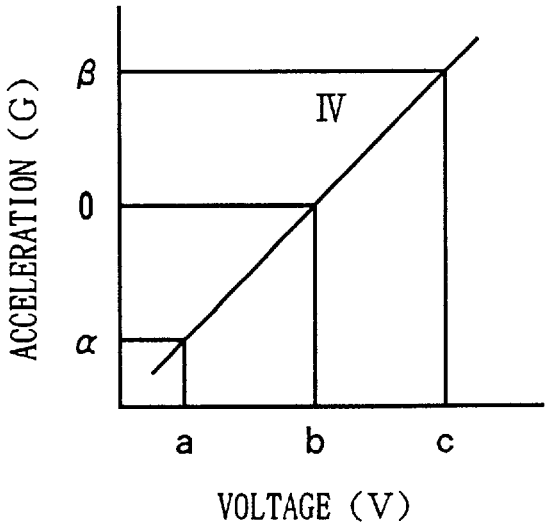
FIG. 33 is a diagram showing a graph of an acceleration (G) against an output voltage (V).

FIG. 33 is a diagram showing a graph of an acceleration (G) against an output voltage (V). Now, as shown in FIG. 16, the angle of inclination of the stick assembly 123M and the output voltages are directly proportional. Therefore, as shown in FIG. 33 with a line IV, accelerations of $\alpha$, 0, and $\beta$ are detected at voltages a, b, and c, respectively.

Figure 35:
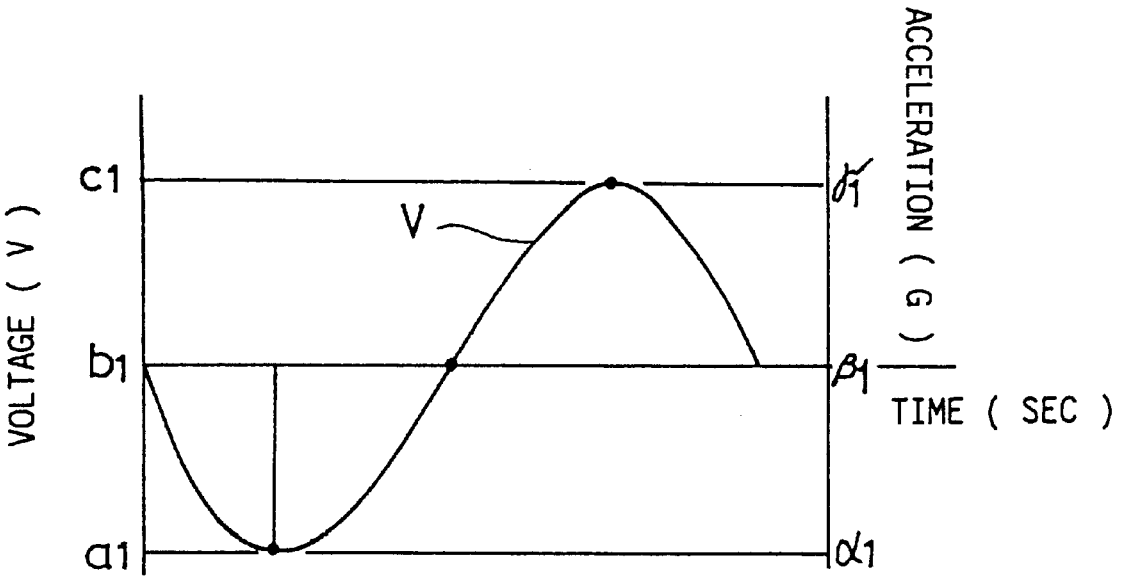
FIG. 35 is a diagram showing a graph of a voltage (V) and an acceleration (G) against time.

FIG. 34 is a diagram showing an example of an application of the acceleration-measuring apparatus of the third embodiment of the present invention. The player 180 of a game shakes his arms and legs with the acceleration-measuring apparatus 160 on his wrists and ankles. Then, a voltage wave form shown in FIG. 35 with a line V will be output from the amplifiers 130, 131 (see FIG. 15) of the signal processing circuits 127M of the acceleration-measuring apparatus 160.

The CPU 133 measures at what speed (slowly or quickly) the player 180 has moved his arms and legs based on the magnitude of the acceleration and the time taken. Time is measured by taking synchronization with the clocks of the clock unit 142.

As shown in FIG. 34, when the player 180 moves his arms and legs as if he is a kick-boxing player, a virtual player 191 moves with a movement corresponding to a movement of the player 180, and attacks a virtual opponent 192.

Also, the acceleration-detecting device 161 may be of a structure in which variants shown in FIGS. 20 and 26 are applied.

Further, the present invention is not limited to these embodiments, but variations and modifications may be made without departing from the scope of the present invention.

The present application is based on Japanese priority applications No. 10-99517 filed on Apr. 10, 1998, and No. 11-052468 filed on Mar. 1, 1999, the entire contents of which are hereby incorporated by reference.

What is claimed is:

1. An acceleration measuring apparatus, comprising:

a movable part provided with a substantially spherical part at a lower end thereof and further provided with a weight, so that when an acceleration is experienced, said movable part is inclined under an effect of a force exerted at said weight;

bearing means in contact with and rotatably supporting said substantially spherical part of said movable part;

recovery means which rotates said substantially spherical part within said bearing means so as to recover an upright position of the movable part; and inclination detecting means which detects a direction of inclination and an angle of inclination of said movable part, wherein the acceleration is measured based on the direction of inclination and the angle of inclination of said movable part, and wherein said recovery means comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said slider is pushed up by said flange and said spring is elastically deformed, and when said movable part is released, said slider is pushed down by an elastic force of said spring and said slider pushes said flange, so that said movable part recovers to an original position thereof.

2. The acceleration measuring apparatus as claimed in claim 1, further comprising;

an attachment member to secure said acceleration measuring apparatus on a part of a human body.

3. The acceleration measuring apparatus as claimed in claim 1, wherein said slider is provided with a plurality of ribs, said ribs being in line contact with an inner surface of said cylindrical part.

4. An input device main body to be mounted on a substrate equipped with a sensor, said main body, comprising:

a movable part having a substantially spherical part provided at a lower end thereof;

bearing means in contact with and rotatably supporting said substantially spherical part of said movable part;

a recovery means which rotates said substantially spherical part within said bearing means so as to recover an upright position of the movable part; and an object to be detected which is provided on said movable part, wherein said input device main body is mounted on said substrate so as to detect a direction of inclination and an angle of inclination of said object to be detected by means of said sensor, and wherein said recovery means comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said slider is pushed up by said flange and said spring is elastically deformed, and when said movable part is released, said slider is pushed down by an elastic force of said spring and said slider pushes said flange, so that said movable part recovers to an original position thereof.

5. An acceleration measuring apparatus, comprising:

a movable part provided with a substantially spherical part at a lower end thereof and further provided with a weight, so that when an acceleration is experienced, said movable part inclines under an effect of a force exerted at said weight;

a bearing unit in contact with and rotatably supporting said substantially spherical part of said movable part;

a recovery unit rotating said substantially spherical part within said bearing unit so as to recover an upright position of the movable part; and inclination detecting unit measuring the acceleration experienced by detecting a direction of inclination and an angle of inclination of said movable part, and wherein said recovery unit comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said flange pushes up said slider and said spring elastically deforms, and when said movable part is released, said spring pushes down said slider by an elastic force thereof and said slider pushes said flange, so that said movable part recovers to an original position thereof.

6. The acceleration measuring apparatus as claimed in claim 5, further comprising;

an attachment member securing said acceleration measuring apparatus on a part of a human body.

7. The acceleration measuring apparatus as claimed in claim 5, wherein said slider is provided with a plurality of ribs, said ribs being in line contact with an inner surface of said cylindrical part.

8. An input device main body to be mounted on a substrate equipped with a sensor, said main body, comprising:

a movable part having a substantially spherical part provided at a lower end thereof;

a bearing unit in contact with and rotatably supporting said substantially spherical part of said movable part;

a recovery unit rotating said substantially spherical part within said bearing unit so as to recover an upright position of the movable part; and an object to be detected is provided on said movable part, wherein said input device main body is mounted on said substrate to detect a direction of inclination and an angle of inclination of said object by said sensor, and wherein said recovery unit comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said flange pushes up said slider and said spring elastically deforms, and when said movable part is released, said spring pushes down said slider by an elastic force thereof and said slider pushes said flange, so that said movable part recovers to an original position thereof.

9. An acceleration measuring apparatus, comprising:

a movable part with a substantially spherical part at a lower end thereof and a weight such that the movable part inclines when subject to an acceleration;

a bearing unit in contact with and rotatably supporting the substantially spherical part of the movable part;

inclination detecting unit detecting the acceleration according to a direction and an angle of inclination of the movable and a recovery unit comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said flange pushes up said slider and said spring elastically deforms, and when said movable part is released, said spring pushes down said slider by an elastic force thereof and said slider pushes said flange, so that said movable part recovers to an original position thereof.

10. An input device main body mountable with a sensor, said input device main body, comprising:

a movable part with a substantially spherical part at a lower end thereof;

a bearing unit in contact with and rotatably supporting the substantially spherical part of the movable part;

an object to be detected by the sensor is provided on said movable part, wherein a direction and an angle of inclination of said object is detect by said sensor and corresponds to an acceleration of the movable and a recovery unit comprises a cover having a cylindrical part, a flange protruding outward from said substantially spherical part, a slider slidably provided in said cylindrical part of said cover, a lower end of said slider being supported by said flange, and a spring which downwardly spring-biasing said slider, wherein, when said movable part is inclined, said flange pushes up said slider and said spring elastically deforms, and when said movable part is released, said spring pushes down said slider by an elastic force thereof and said slider pushes said flange, so that said movable part recovers to an original position thereof.

* * * * *

UNITED STATES PATENT AND TRADEMARK OFFICE

CERTIFICATE OF CORRECTION

PATENT NO. : 6,760,006 B2
DATED : July 6, 2004
INVENTOR(S) : Takashi Arita et al.

It is certified that error appears in the above-identified patent and that said Letters Patent is hereby corrected as shown below:

Column 18,
Line 17, after “movable” insert -- part --.
Line 43, after “movable” insert -- part --.

Signed and Sealed this

Second Day of November, 2004

JON W. DUDAS
*Director of the United States Patent and Trademark Office*